US007393155B2

(12) United States Patent
Riccobene

(10) Patent No.: US 7,393,155 B2
(45) **Date of Patent: *Jul. 1, 2008**

(54) IRREGULAR TESSELLATED BUILDING UNITS

(75) Inventor: Thomas S. Riccobene, Albuquerque, NM (US)

(73) Assignee: Riccobene Designs LLC, Albuquerque, NM (US)

( * ) Notice: Subject to any disclaimer, the term of this patent is extended or adjusted under 35 U.S.C. 154(b) by 169 days.

This patent is subject to a terminal disclaimer.

(21) Appl. No.: 10/550,121

(22) PCT Filed: Mar. 24, 2004

(86) PCT No.: PCT/US2004/009148

§ 371 (c)(1),
(2), (4) Date: Sep. 19, 2005

(87) PCT Pub. No.: WO2004/085755

PCT Pub. Date: Oct. 7, 2004

(65) Prior Publication Data

US 2006/0182923 A1 Aug. 17, 2006
US 2007/0098945 A2 May 3, 2007

Related U.S. Application Data

(60) Provisional application No. 60/503,936, filed on Sep. 18, 2003.

(51) Int. Cl.
*E01C 5/00* (2006.01)

(52) U.S. Cl. ..... 404/38; 404/41; 428/44; 428/48; 52/603

(58) Field of Classification Search ..... 428/44, 428/48; 404/37, 38, 41, 34; 52/311.2, 392, 52/603

See application file for complete search history.

(56) References Cited

U.S. PATENT DOCUMENTS 4,217,740 A 8/1980 Assanti (Continued)

FOREIGN PATENT DOCUMENTS

DE 4232300 3/1994

(Continued)

OTHER PUBLICATIONS

Nature Walk™ Natural Flagstone Appeal for Pedestrian Traffic, Sep. 2003.

(Continued)

*Primary Examiner*—Alexander Thomas
(74) *Attorney, Agent, or Firm*—Greer, Burns & Crain, Ltd

(57) ABSTRACT

An irregular, tessellated building unit comprises x primary elements, wherein x is an integer equal to or greater than 1. The primary element is a rotational tessellation having a plural pairs of sides extending in a generally radial direction from plural vertices, respectively. In each pair, the two sides are rotationally spaced by an angle that is divided evenly into 360 degrees. Preferably, all of the sides are irregularly shaped, but one or more sides could be wholly or partially straight. Optionally, spacers are provided on the sides of each unit. A wide variety of units may be constructed having different numbers and arrangements of primary elements. As all the units are combinations of primary elements, they readily mate with each other. A surface covering comprises a multiplicity of units assembled to form a continuous surface without overlap between units and without substantial gaps between units. A structure, such as a wall or column can be formed of building units of the invention. Because of the irregular side configurations, and different sizes and shapes of individual units, the resulting surface or structure has a natural, non-repeating pattern appearance. Optionally, minor surface and edges variations are made from unit to unit to further enhance the natural appearance of the surface covering or structure.

7 Claims, 17 Drawing Sheets

U.S. PATENT DOCUMENTS

| | | | | | |
|---|---|---|---|---|---|
| 5,267,810 | A | * | 12/1993 | Johnson | 404/41 |
| 5,286,139 | A | * | 2/1994 | Hair | 404/41 |
| 5,486,066 | A | | 1/1996 | Hagenah | |
| 5,524,396 | A | | 6/1996 | Lalvani | |
| 5,588,775 | A | | 12/1996 | Hagenah | |
| 5,597,591 | A | | 1/1997 | Hagenah | |
| 5,884,445 | A | * | 3/1999 | Woolford | 52/311.2 |
| 5,945,181 | A | | 8/1999 | Fisher | |
| D439,677 | S | * | 3/2001 | Mattox | D25/113 |
| 6,263,633 | B1 | | 7/2001 | Hagenah | |
| D480,819 | S | | 10/2003 | Barbier | |
| 6,881,463 | B2 | | 4/2005 | Riccobene | |
| D536,058 | S | | 1/2007 | Riccobene | |
| D537,501 | S | | 2/2007 | Riccobene | |
| 2007/0077387 | A1 | | 4/2007 | Riccobene | |

FOREIGN PATENT DOCUMENTS

| | | |
|---|---|---|
| DE | 4333942 | 4/1995 |
| DE | 10001967 | 7/2001 |
| WO | 0153612 | 7/2001 |

OTHER PUBLICATIONS

Website: www.sf-kooperation.de/english/index Canteon® : CIS 300-10; Pentalith, Sep. 2003.

Designing Tessellations: The Secrets of Interlocking Patterns: Author: Jinny Beyer: Chapter 7: The Keys to Creating Interlocking Tessellations: p. 125-153, 1999.

Website: www.geckostone.com Geckostone™, Mar. 2003.

Website: www.matfcrete.net/RandonStone.htm Matcrete The Ultimate in Concrete Design, Dec. 2002.

Website: www.superstone.com Split Rock, Jun. 2005.

Website: www.mathforum.org/sum95.suzanne/whattess.html What is Tessellation?, Apr. 2002.

Website: www.riverdeep.net/products/other/tesselmania.html Tessellation!® Deluxe, Jun. 2003.

Website: www.learningcompanyschool.com Tessellation!® Deluxe, Jun. 2003.

Concrete Landscaping/Products; Old Castle Brochure; Published 2002.

Landscaping Stones; Mat Stone Brochure; Nature Walk, Garden Walk Published 2003.

Patio Dreamscapes; Pavestone Brochure; Sandstone System Published 2003.

Paving Stone Dreamscapes; Pavestone Brochure Published 2003.

Retaining Walls; Pavestone Brochure Published 2002.

Beautiful Edgers; Pavestone Brochure Published 2002.

* cited by examiner

IRREGULAR TESSELLATED BUILDING UNITS

CROSS-REFERENCE

This application is a U.S. National Stage application of international application No. PCT/US2004/009148 filed Mar. 24, 2004 under the Patent Cooperation Treaty, which claims priority from U.S. patent application Ser. No. 10/395,537 filed Mar. 24, 2003, now U.S. Pat. No. 6,881,463 issued Apr. 19, 2005, and U.S. provisional patent application Ser. No. 60/503,936 filed Sep. 18, 2003.

FIELD OF THE INVENTION

This disclosure relates to repeating elements forming a surface covering and/or structure, and more specifically relates to stones, bricks, pavers and tiles for forming surface coverings, walls or other structures.

BACKGROUND OF THE INVENTION

It is well known to cover surfaces, such as walkways, driveways, patios, floors, work surfaces, walls and other interior or exterior surfaces with stones, bricks, pavers, tiles and other architectural surface covering units. It is further known to construct walls and other structures with stone and bricks. Natural stone surface coverings and structures are constructed by cutting and fitting irregularly sized and shaped stones. The work requires a skilled stonemason to select, cut and fit the stone. It is labor intensive, and accordingly expensive. Custom built natural stone surfaces and structures, however, are very attractive and desirable.

Conventional surface coverings and structures are also constructed of manufactured pavers, bricks, tiles or other units. Manufactured units are typically provided in geometric shapes, such as squares, rectangles and hexagons, or combinations thereof Surfaces covered with manufactured units typically are laid in repeating patterns. Alternatively, it is known to lay conventional units in random, non-repeating patterns. Random patterns are regarded as esthetically pleasing and are becoming more popular. However, random patterns of manufactured units do not have the degree of natural irregularity that is desirable in custom stone walkways, driveways, patios, walls and the like.

Tessellated designs are generally known. For example, M. C. Escher is widely know to have created tessellated designs comprised of repeating patterns of recognizable animals, plants and things, such as geckos, birds, fish and boats. It is an object of tessellated design to feature repeating patterns.

SUMMARY OF THE INVENTION

According to the present invention there is provided irregular, tessellated building units. As used herein, the term "building units" or "units" refers to a bricks, blocks, stones, tiles or other two or three dimensional objects that can be used in the construction of floors, walls, retaining walls, columns or other structures, including interior and exterior structures, and including load bearing and non-load bearing structures. Each building unit has at least one face comprised of one or more primary rotational tessellation elements.

The primary element has at least two, preferably three vertices. First and second sides extend in a generally radial direction relative to the first vertex. The first and second sides are rotational images of one another. By the term "rotational image" it is meant that the sides have substantially the same length and configuration, such that a first side of one unit will mate with a second side of another unit. Third and fourth sides extend in a generally radial direction relative to the second vertex. The first and second sides are rotationally spaced apart from one another by an angle $\theta$, where $\theta$ is 360 degrees divided by n, where n is an integer (e.g., 60, 90, 120 or 180 degrees). The third and fourth sides are rotationally spaced by an angle $\phi$, where $\phi$ is also evenly divided into 360 degrees. The sum of angles $\theta$ and $\phi$ is preferably 180, 240, 270 or 300 degrees. Preferred embodiments of the invention have primary elements with a third vertex, with fifth and sixth sides extending radially from the third vertex, rotationally spaced by an angle $\gamma$. In these preferred embodiments, the sum of angles, $\theta$, $\phi$ and $\gamma$ is 360 degrees. The primary element may optionally include a substantially straight side.

In accordance with the invention, preferably all the sides of the primary element are irregularly shaped. By the terms "irregularly shaped" and "irregular configuration" it is meant that the side appears jagged or rough hewn, and is not a straight line or a smooth curve, such that when multiple units are assembled to form a surface a regular geometric pattern is not readily apparent. However, it should be understood that an irregularly shaped side might comprise a multiplicity of straight-line segments, such that the general appearance of the side is irregular. Optionally, one or more sides could consist of or include a straight segment or a regular geometric curve.

Each building unit of the invention has at least one face that is comprised of x primary elements, where x is an integer equal to or greater than 1, preferably 1 to 6. The primary element is an irregular rotational tessellation as described above. Units of different sizes and shapes can be constructed with different numbers and arrangements of primary elements. Because all the units are combinations of primary elements, they readily mate with each other. As a result of the irregular side configurations, and different sizes and shapes of individual units, one can construct a continuous surface or structure that has a natural and non-repeating pattern appearance. As indicated there is a tessellation pattern, but the pattern is difficult to visualize. The surface has the appearance of being custom built.

One application of the invention is a surface covering. The term "surface coverings" is used in its broadest meaning, and includes architectural and product surfaces, interior and exterior surfaces, and floors, walls and ceilings. The surface covering comprises a multiplicity of units assembled to form a continuous surface without overlap between units and without substantial gaps between units.

Another application of the invention is constructing walls, columns or other structures. Each unit has a tessellated front face comprising one or more primary elements as described above, sides extending substantially perpendicularly from the front face, and a rear face. Preferably, connectors such as lugs or notches are provided to improve the structural connection between units. A structure, such as retaining wall, constructed of such units having different sizes and shapes will have a natural and custom appearance.

A preferred, optional feature of the invention is a building unit having spacers on the sides of the units. The spacers are preferably indented from the surface, and typically are not visible in the completed structure. The spacers of each unit define the primary element(s) of the unit, and maintain the integrity of the tessellation pattern. The upper visible side edges of the unit are varied somewhat relative to mating edges to cause a variable gap width between units. Variable gap width further promotes a natural, custom appearance.

Another optional feature of the invention is providing indicia on or adjacent one or more sides of each unit to assist in construction of surface coverings or structures. Spacers can function as mating indicia. Alternatively, mating indicia can be separately provided.

Yet another, optional aspect of the invention is to vary the appearance of each unit to further enhance the natural, custom appearance of the surface covering. Variations include edge, surface and color variations.

The foregoing and other aspects and features of the invention will become apparent to those of reasonable skill in the art from the following detailed description, as considered in conjunction with the accompanying drawings.

BRIEF DESCRIPTION OF THE DRAWINGS

FIG. 1 is a plan view of a first surface covering of the first embodiment.

FIG. 2 is an enlarged plan view of a primary element for a first building unit of the first embodiment.

FIG. 3 is a plan view of a second surface covering of the first embodiment.

FIG. 4 is an enlarged plan view of a second unit of the first embodiment.

FIG. 5 is a plan view of a third surface covering of the first embodiment.

FIG. 6 is an enlarged plan view of a third unit of the first embodiment.

FIG. 7 is a plan view of a fourth surface covering of the first embodiment.

FIG. 8 is an enlarged plan view of a fourth unit of the first embodiment.

FIG. 9 is an enlarged plan view of a fifth unit of the first embodiment.

FIG. 10 is an enlarged plan view of a sixth unit of the first embodiment.

FIG. 11 is an enlarged plan view of a primary element for a first building unit of the second embodiment.

FIG. 12 is a plan view of a second unit of the second embodiment.

FIG. 13 is a plan view of a third unit of the second embodiment.

FIG. 14 is a plan view of a fourth unit of the second embodiment.

FIG. 15 is a plan view of a fifth unit of the second embodiment.

FIG. 16 is a plan view of an exemplary surface covering of the second embodiment.

FIG. 17 is an enlarged plan view of a primary element of a first building unit of the third embodiment.

FIG. 18 is a plan view of a second unit of the third embodiment.

FIG. 19 is a plan view of a third unit of the third embodiment.

FIG. 20 is a plan view of a fourth unit of the third embodiment.

FIG. 21 is a plan view of a fifth unit of the third embodiment.

FIG. 22 is a plan view of an exemplary surface covering of the third embodiment.

FIG. 23 is an enlarged plan view of a primary element for a first building unit of the fourth embodiment.

FIG. 24 is a plan view of a second unit of the fourth embodiment.

FIG. 25 is a plan view of a third unit of the fourth embodiment.

FIG. 26 is a plan view of a fourth unit of the fourth embodiment.

FIG. 27 is a plan view of an exemplary surface covering of the fourth embodiment.

DETAILED DESCRIPTION OF THE PREFERRED EMBODIMENTS

Preferred embodiments of the present invention are described below by way of example only, with reference to the accompany drawings.

Figure 1:
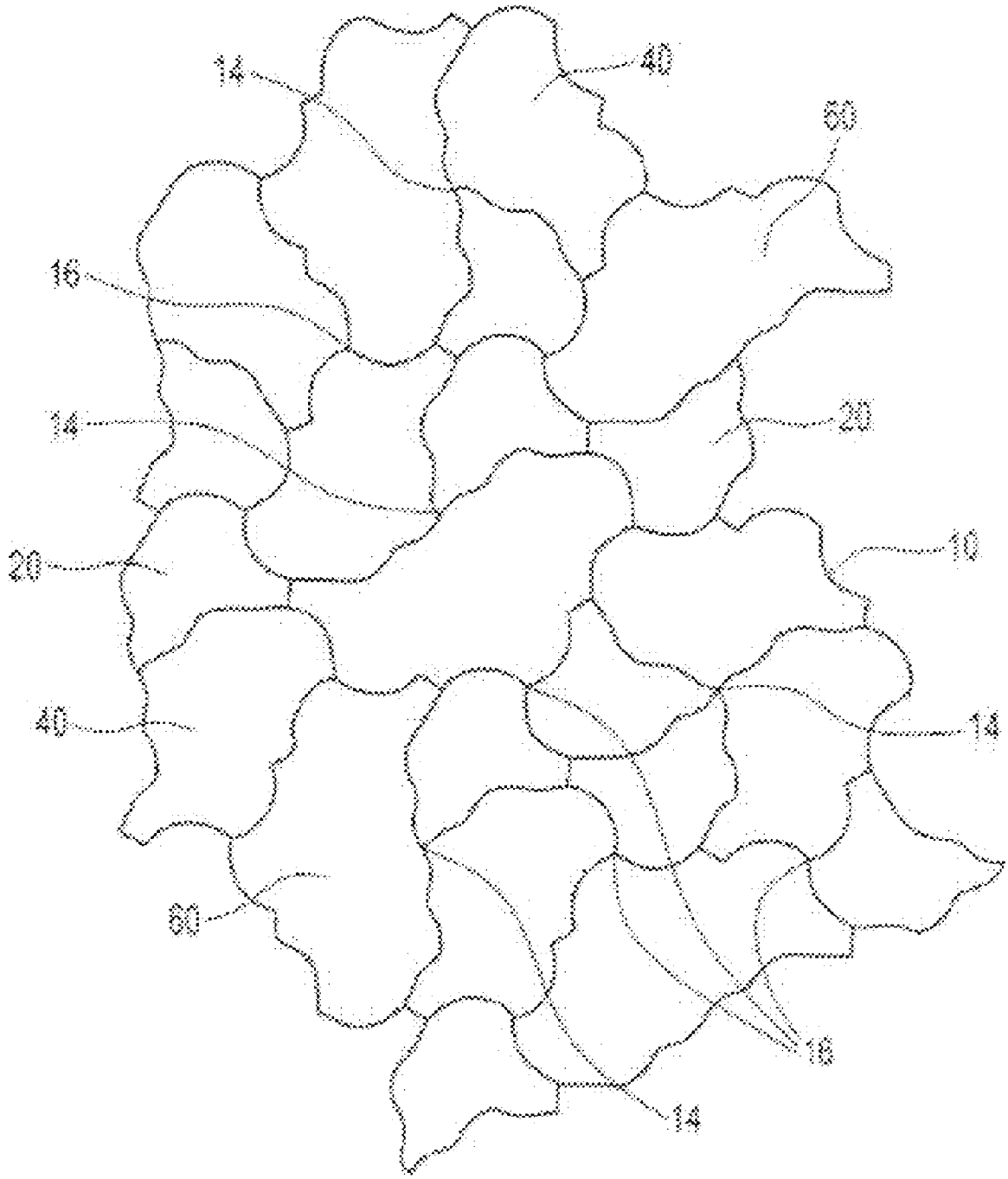
FIGS. 1-10 are illustrations of a first embodiment of irregular, tessellated building units of the invention.

FIG. 1 shows a surface covering 10 constructed in accordance with a first embodiment of the present invention. Surface covering 10 comprises an arrangement of building units without substantial gaps or overlapping. The term "substantial gaps" means comparatively large gaps, holes or spaces that would detract from the appearance of the covered surface. The term, "without substantial gaps" means no gaps and/or comparatively small gaps that may be filled with sand or mortar, which does not adversely detract from the appearance of the surface covering or structure. Building units may be molded or otherwise made of concrete, stone, ceramics, plastic, natural or synthetic rubber, glass or other suitable material, or combinations thereof. In FIG. 1, surface covering 10 is comprised of three different sized units 20, 40 and 60. The units have what appear to be irregular configurations. Further, the surface covering 10 has the appearance of a natural, custom surface, i.e., there is no readily apparent repeating pattern.

Figure 2:
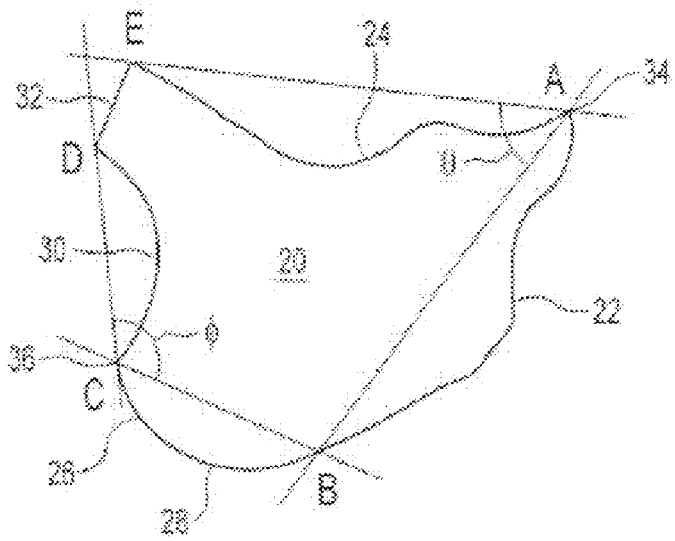

An enlarged view of unit 20 is shown in FIG. 2. The unit comprises a single primary element 20 of a rotational tessellation as will be described in greater detail below. Primary element 20 has a first side 22 extending between points A and B. Second side 24 extends between points A and E. A transverse side 26 extends between points B and E. Transverse side 26 preferably comprises a series of segments, namely, a third side 28 extending between points B and C, a fourth side 30 extending between points C and D, and an optional fifth side 32 extending between points D and E. First 22 and second 24 sides are irregular, rotational images of one another. First and second sides extend in a generally radial direction relative to a common first vertex 34, and are rotationally spaced by an angle θ. Angle θ is derived from the formula 360°/n where the variable n is an integer, preferably selected from the group of 2, 3, 4 or 6. Thus, angle θ is preferably 60, 90, 120 or 180 degrees. Although n is preferably 6 or less, n could be larger than 6 in some applications. In the example shown in FIG. 2, the variable n is equal to 6 and θ is 60 degrees. The third 28 and fourth 30 sides are rotational images, have a common second vertex 36, and are rotationally spaced by an angle ϕ. Angle ϕ is derived from the formula 360°/m where the variable m is an integer. Preferably, the sum of angles θ and ϕ is 180, 240, 270 or 300 degrees. In the example shown in FIG. 2, variable m is 3 and ϕ is 120°. The fifth side 32 is optional, that is, the third and fourth sides could extend between points B and E, and thereby complete the circumference of the unit. The fifth side is a substantially straight line in this embodiment. Because the angle θ is defined as 360°/n, n units may be arranged in a rotational tessellation about first vertex 34. Similarly, because the angle ϕ is defined as 360°/m, m units maybe arranged in a rotational tessellation about second vertex 36.

Figure 3:
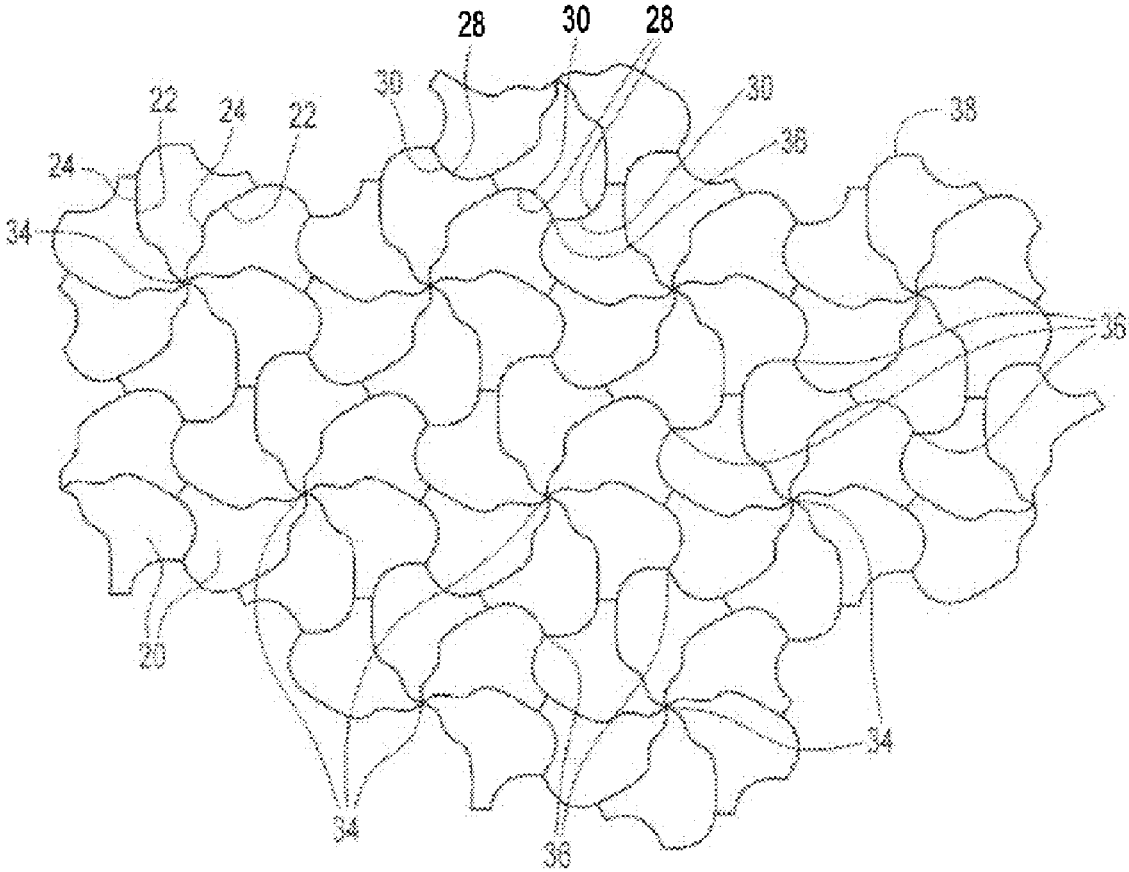

FIG. 3 illustrates a surface covering 38 formed of a multiplicity of units 20. The first sides 22 mate with second sides 24 of adjacent units. In an analogous fashion, third sides 28 mate with fourth sides 30 of adjacent units. Fifth sides mate with each other. In the embodiment shown in FIG. 3, six units form a complete rotational tessellation about first vertex points 34. Further, three units form a complete rotational tessellation about second vertex points 36.

Figure 4:
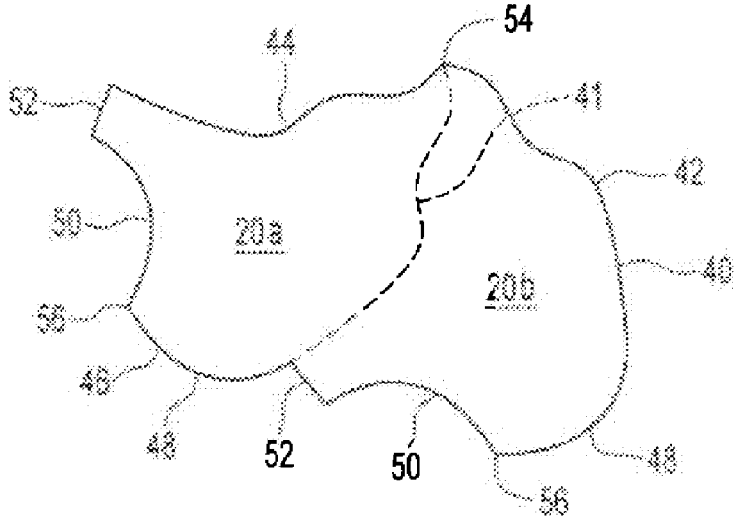

FIG. 4 illustrates a second, medium size unit 40. Unit 40 comprises two primary elements 20*a* and 20*b* as indicated by broken line 41. Unit 40 has sides that match unit 20, namely, a first side 42, second side 44, and transverse side 46 having third sides 48, fourth sides 50 and fifth sides 52. Unit 40 further includes a first vertex 54 and two second vertices 56. In unit 40, the angle between first side 42 and second side 44 is 120°.

Figure 5:
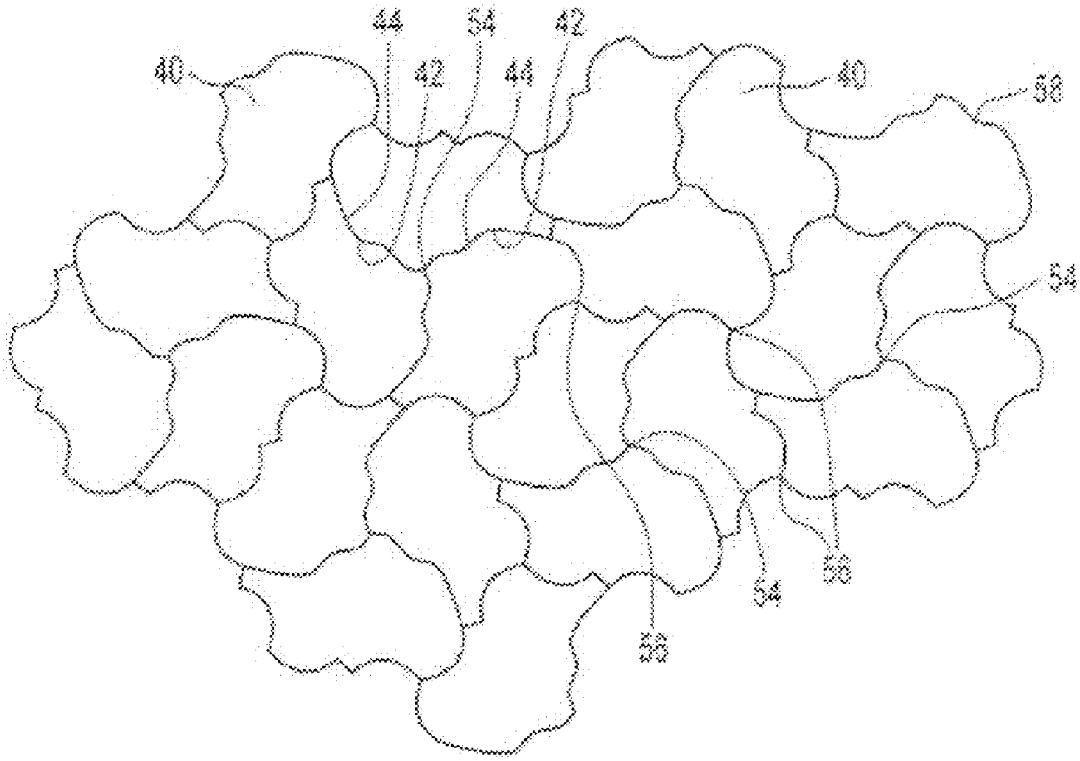

FIG. 5 illustrates a surface covering 58 comprised entirely of second units 40. Three units 40 complete a rotational tessellation about vertex 54. Three units 40 also comprise a complete rotational tessellation about second vertex 56.

Figure 6:
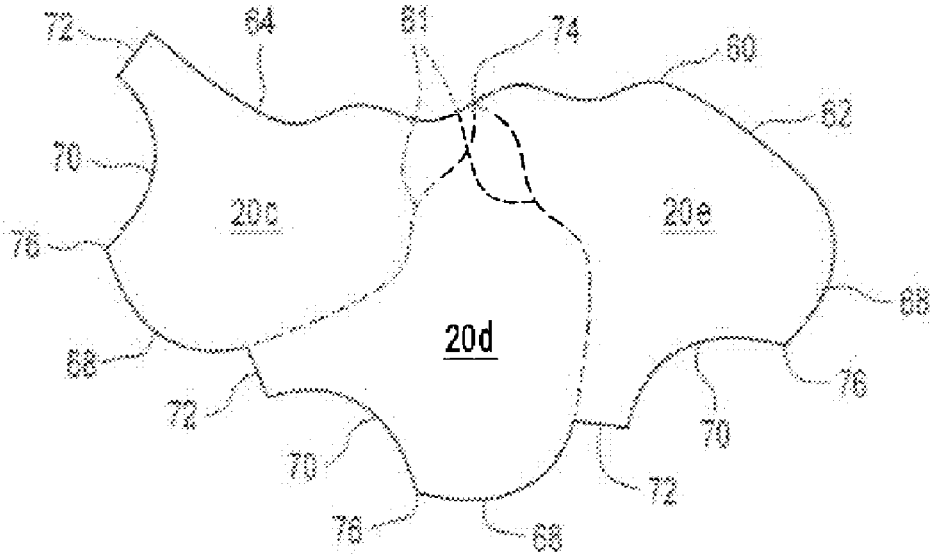

FIG. 6 illustrates a third or large unit 60, comprising three primary elements 20*c*, 20*d* and 20*e* as shown by broken lines 61. Unit 60 has sides that match units 20 and 40, namely first side 62, second side 64, third sides 68, fourth sides 70, and fifth sides 72. Unit 60 further includes a first vertex 74 and second vertices 76. In unit 60, the angle between the first side 62 and second side 64 is 180 degrees.

Figure 7:
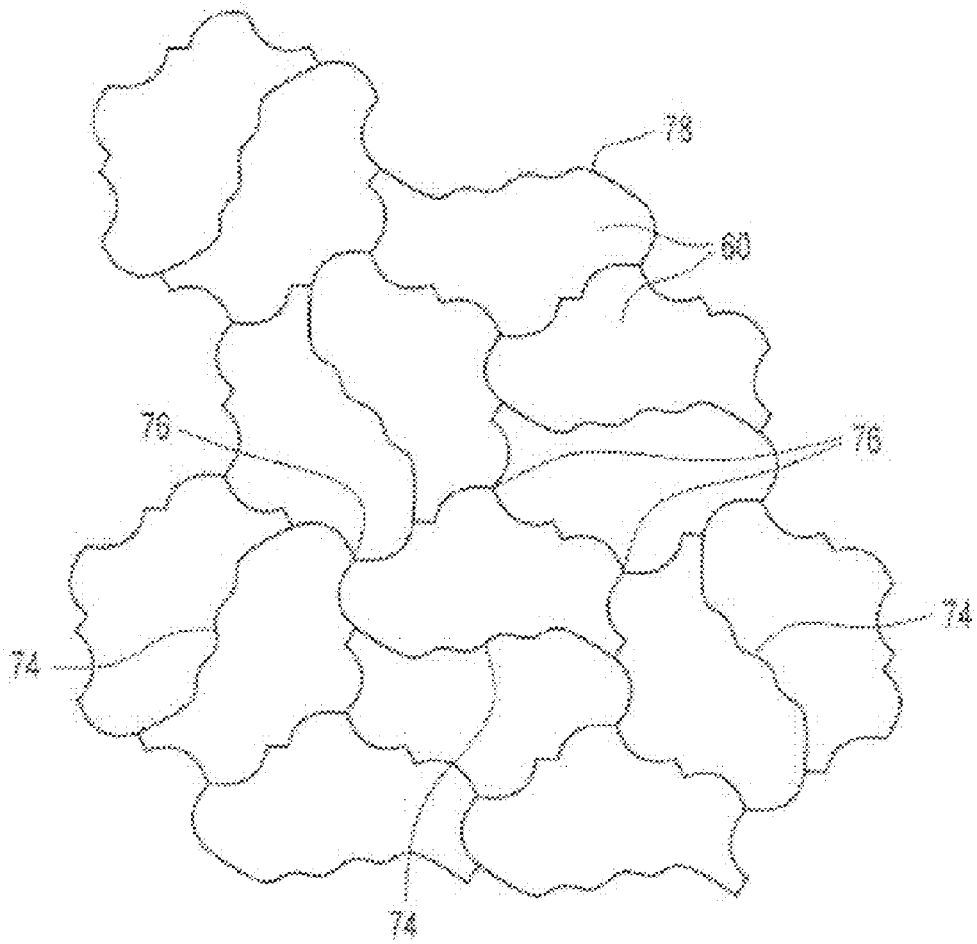

FIG. 7 illustrates the surface covering 78 comprised entirely of third units 60. Two units 60 complete a rotational tessellation about first vertex 74. Three units 60 complete a rotational tessellation about second vertices 76.

Figure 8:
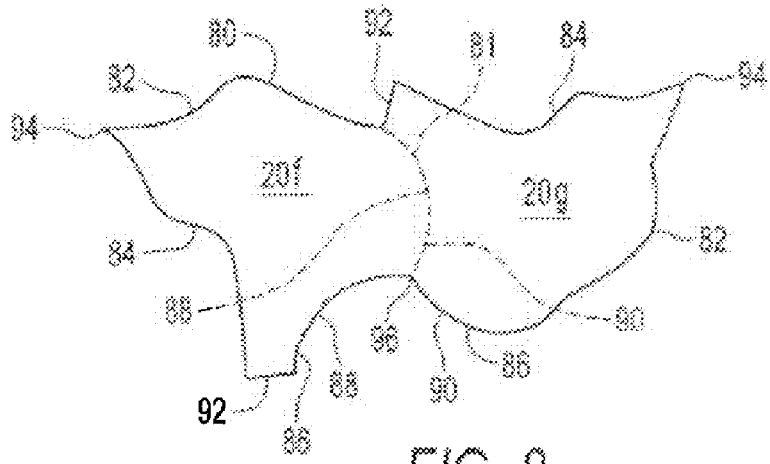
Figure 9:
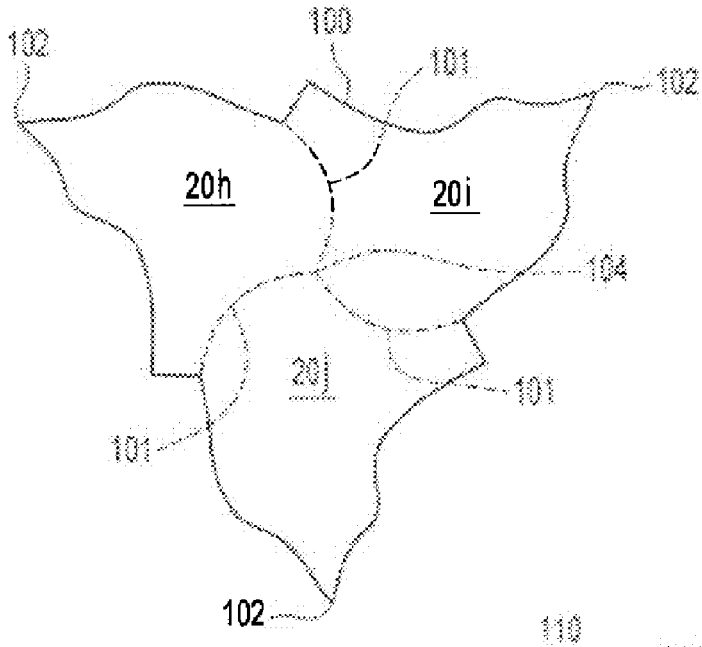
Figure 10:
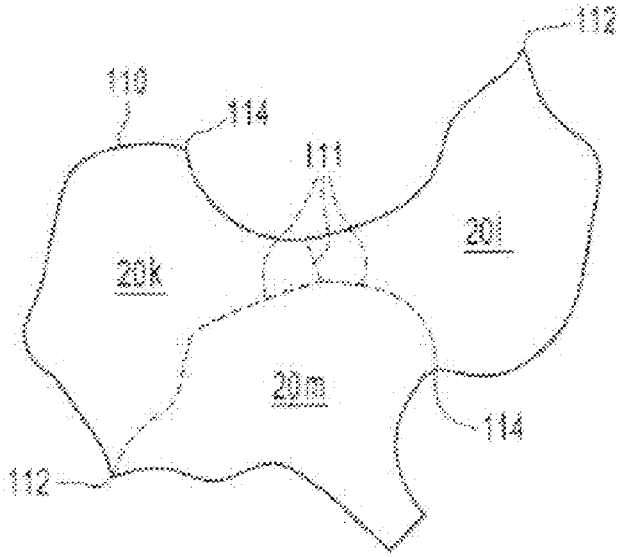

FIGS. 8-10 illustrate how building units may be made of different sizes and shapes by combining primary elements 20. In FIG. 8, unit 80 comprises two elements 20*f* and 20*g*, as reflected by dashed line 81. Unit 80 has two first sides 82, two second sides 84, a third side 88, a fourth side 90, and two fifth sides 92. Unit 80 has two first vertices 94 and a single second vertex 96.

FIG. 9 illustrates another example unit 100 comprising three primary elements 20*h*, 20*i* and 20*j*, as shown by broken lines 101, that are rotationally tessellated about second vertex 104. Unit 100 has three first vertices 102.

FIG. 10 illustrates yet another example unit 110 comprising three primary elements 20*k*, 201 and 20*m* as shown by broken lines 111. Unit 110 has two first vertices 112 and two second vertices 114. As will be appreciated by persons skilled in the art, additional units may be formed in other combinations of primary elements 20. The examples shown in FIGS. 8-10 are not ideal for construction of concrete pavers due to sharp edges or narrow mid-sections, but could be feasible if built from other materials. The examples are presented to illustrate the concept of forming units having different sizes and/or shapes by combining primary elements in different ways.

Returning to FIG. 1, one can visualize a plurality of units rotationally tessellated about each first vertex 14 and each second vertex 16. Each rotational tessellation may contain one or more small 20, medium 40 or large 60 units, or a combination thereof Because of the irregularly shaped sides of each unit and the size variations among the units, the surface appears to be natural and custom fitted, that is, a regular geometric pattern is not readily apparent. Although the embodiment of FIG. 1 has three different size units, namely, single, double and triple element units, it is contemplated that numerous variations are possible, including, for example, a combination of only units 20 and 40, or a combination of only units 40 and 60. Further, it is contemplated that a surface covering could include units 80, 100 or 110, or any other units comprised of a combination of primary elements.

Figure 11:
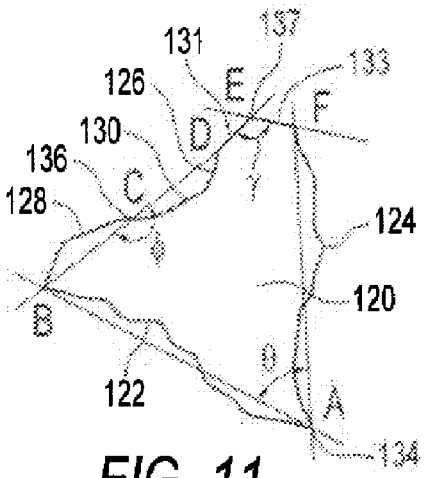
FIGS. 11-16 are illustrations of a second embodiment of irregular, tessellated building units of the invention.

FIGS. 11-16 illustrate building units and an exemplary surface covering of a second embodiment of a rotational tessellation element of the invention. FIG. 11 shows a primary element 120 comprised of six sides, namely, first side 122 extending between points A and B, second side 124 extending between points A and F, third side 128 extending between points B and C, fourth side 130 extending between points C and D, fifth side 131 extending between sides D and E and sixth side 133 extending between points E and F. Together, sides 3 to 6 form transverse side 126. Element 120 has three vertices, namely, first vertex 134, second vertex 136, and third vertex 137. First 122 and second 124 sides are irregular, rotational images of one another, radiate from first vertex 134, and are rotationally spaced by an angle θ of 60 degrees. The third 128 and fourth 130 sides are rotational images of one another, radiate from second vertex 136 and are rotationally spaced by an angle 100 of 180 degrees. Fifth 131 and sixth 133 sides are irregular, rotational images of one another, radiate from third vertex 137 and are rotationally spaced by an angle γ of 120 degrees. All six sides are preferably irregular in shape.

Figure 12:
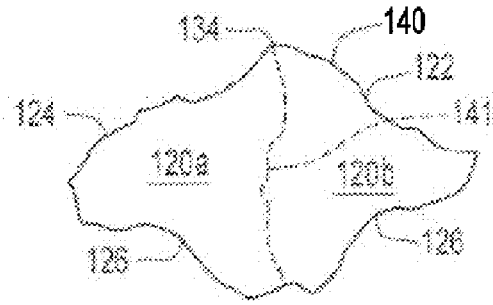

FIG. 12 illustrates a unit 140 comprised of two basic elements 120*a* and 120*b* as indicated by broken lines 141. Elements 120*a* and 120*b* are adjacent elements in a rotation about first vertex 134. The basic elements are joined at an interface 141 of first and second sides.

Figure 13:
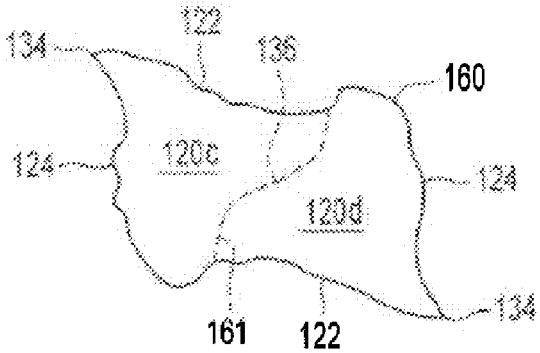

FIG. 13 illustrates a unit 160 comprised of two basic elements 120*c* and 120*d* as indicated by broken line 161. The basic elements are joined at an interface of sides three and four. Elements 120*c* and 120*d* share a second vertex 136.

Figure 14:
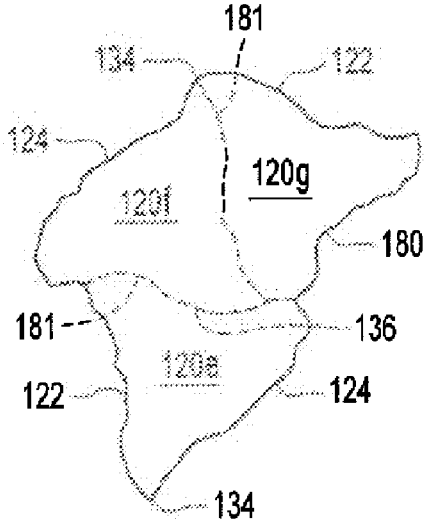

FIG. 14 illustrates a unit 180 comprised of three basic elements 120*e*, 120*f* and 120*g* as indicated by broken lines 181. Elements 120*f* and 120*g* are joined along first-second side interfaces and share a common first vertex 134. Elements 120*e* and 120*f* are joined at third-fourth side interfaces and share a common second vertex 136.

Figure 15:
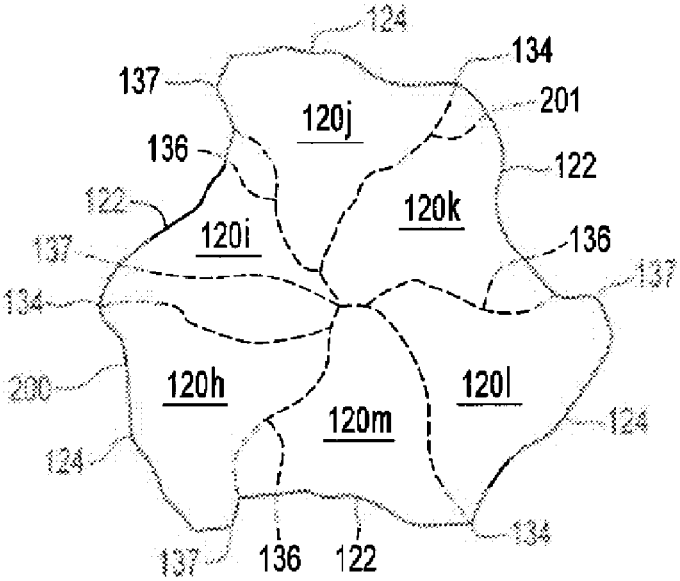

FIG. 15 illustrates a unit 200 comprised of six basic elements 120*h-m* as indicated by broken lines 201. First 134, second 136 and third vertices 137 are identified in FIG. 15. As one may observe, unit 200 comprises a pair of primary elements from three different rotations about first vertices 134.

FIGS. 12-15 thus illustrate four ways that basic elements may be combined to form different size and shape units. Additional units may be formed by other combinations of primary element 120.

Figure 16:
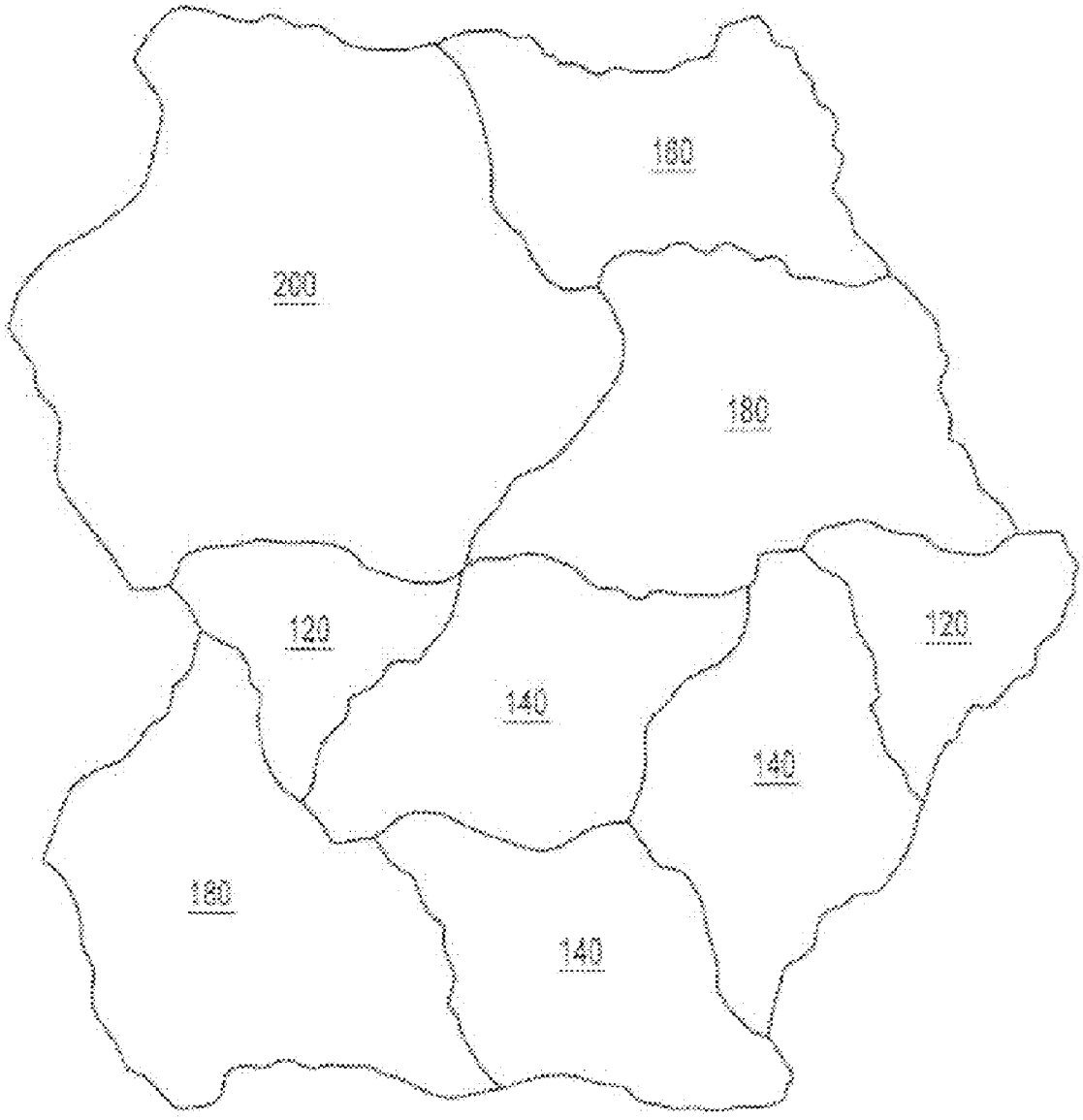

FIG. 16 illustrates an exemplary surface covering formed of the units illustrated in FIGS. 11-15. A great variety of surface coverings may be formed utilizing combinations of units 120, 140, 160, 180 and 200, as well as other units formed from different combinations of primary elements of the second embodiment.

FIGS. 17-22 illustrate building units and an exemplary surface covering of a third embodiment of the rotational tessellation element of the invention.

Figure 17:
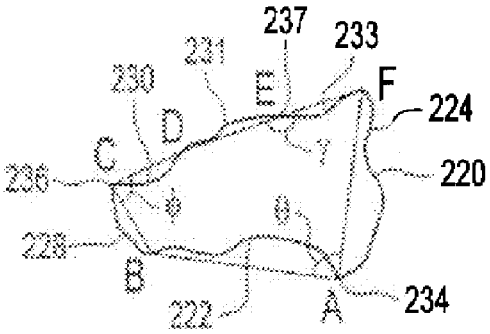
FIGS. 17-22 are illustrations of a third embodiment of irregular, rotational tessellation faces for building units of the invention.

FIG. 17 illustrates a primary element 220 of the third embodiment. Primary element 220 has a first side 222 extending between points A and B, a second side 224 extending between points A and F. The second side 224 is a rotated image of first side 222 about first vertex 234. The angle θ of rotation is 90 degrees in the third embodiment. Basic element 220 further includes third side 228 extending between points B and C and fourth side 230 extending between points C and D. Fourth side 230 is a rotated image of third side 228 about second vertex 236. The angle of rotation between sides three and four is angle ϕ which in case of the third embodiment is 90°. Basic element 220 further comprises a fifth side 231 extending between points D and E, and a sixth side 233 extending between points E and F. Sixth side 233 is a rotated image of fifth side 231 about third vertex 237. The angle of rotation γ there between is 180 degrees.

Figure 18:
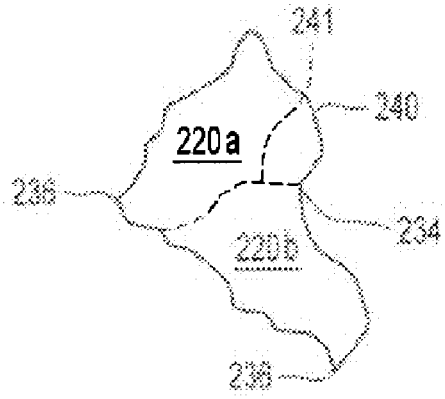

FIG. 18 illustrates a unit 240 comprised of two primary elements 220*a* and 220*b* as indicated by broken lines 241. Primary elements 220*a* and 220*b* are joined at the interface between sides one and two of the respective units, and share a common first vertex 234.

Figure 19:
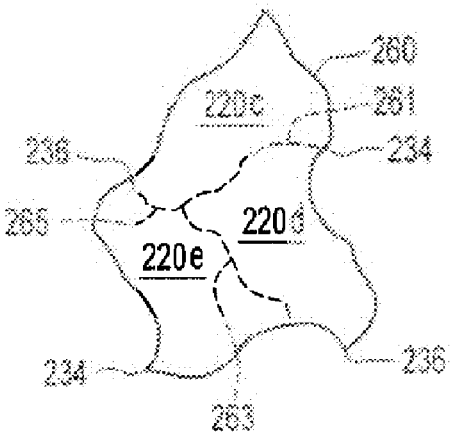

FIG. 19 is a third unit 260 comprised of three primary elements 220*c*, 220*d* and 220*e* as indicated by broken lines 261, 263, 265. Elements 220*c* and 220*d* are joined at the interface 261 of sides one and two of adjacent elements, and have a common first vertex 234. Element 220*e* is joined to element 220*d* at the interface 263 between sides five and six, respectively, and share common third vertex 237. Element 220*e* is joined to element 220*c* at the interface 265 between sides three and four, respectively and share common second vertex 236.

Figure 20:
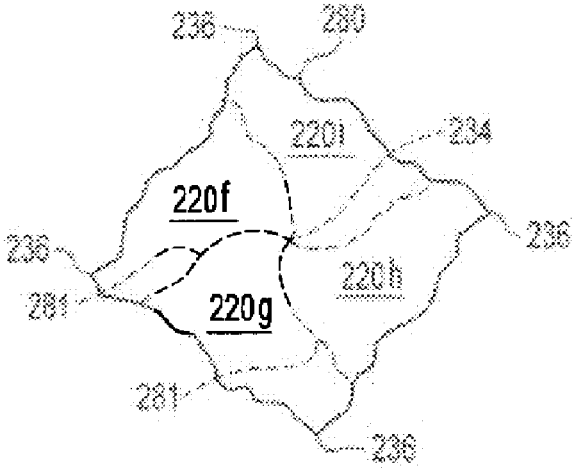

FIG. 20 illustrates a unit 280 comprised of four primary elements from the third embodiment, namely elements 220*f*, 220*g*, 220*h* and 220*i* as indicated by broken lines 281. All four elements revolve around first vertex 234.

Figure 21:
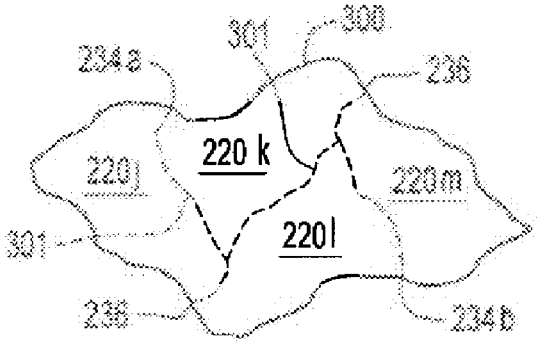

FIG. 21 illustrates a fifth unit 300 comprised of four primary elements 220*j-m*, as indicated by broken lines 301. In unit 300 two elements 220*j* and 220*k* are taken from a rotation about first vertex 234*a*. Elements 2201 and 220*m* comprise adjacent elements about first vertex 234*b*.

FIGS. 18-21 thus illustrate four ways that basic elements may be combined to form different size and shape units. Additional units may be formed by other combinations of primary element 220.

Figure 22:
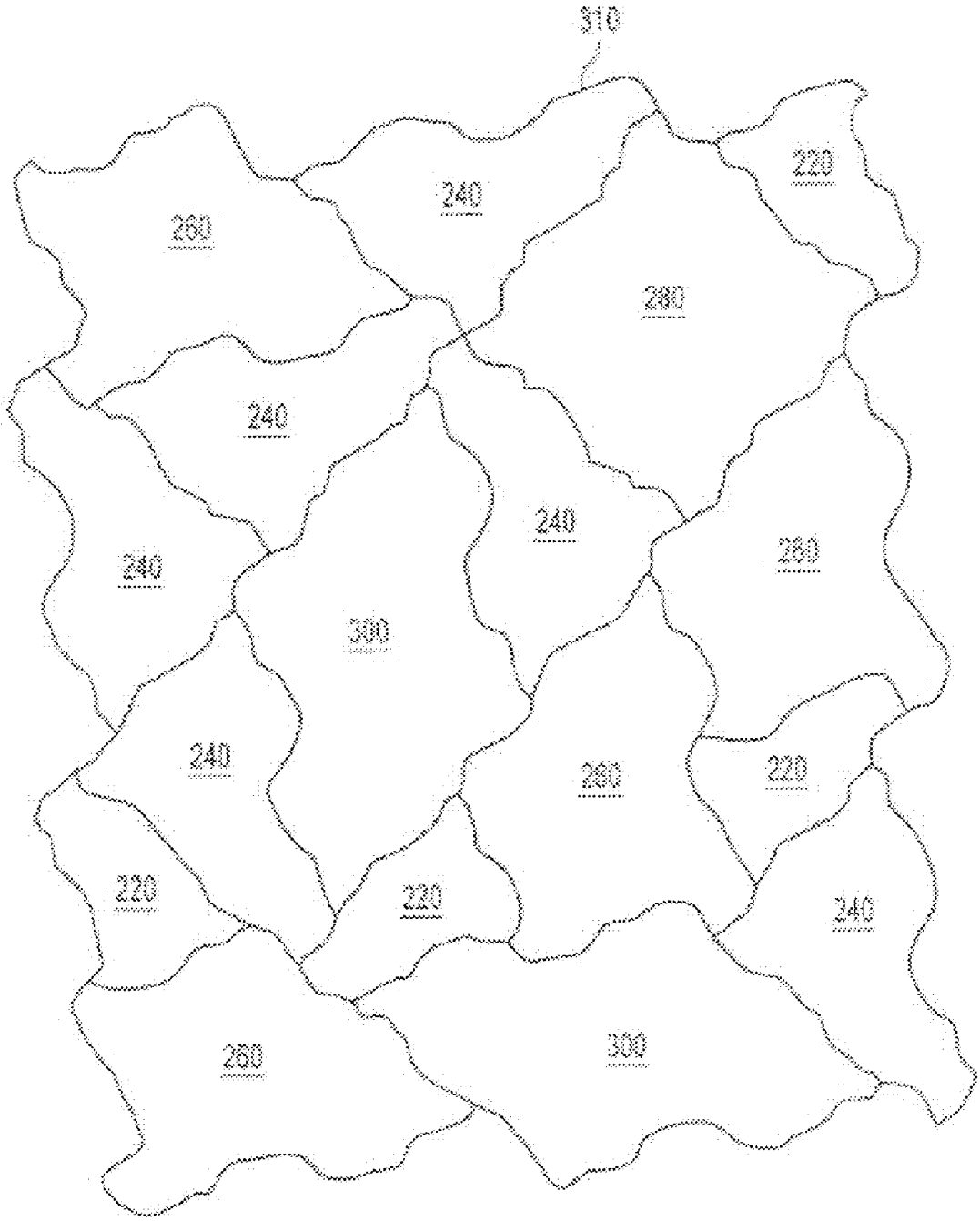

FIG. 22 illustrates a surface covering formed from a mixture of units 220, 240, 260, 280, 300. As with the other embodiments, the surface covering appears to be an irregular custom made surface, with no apparent repeating pattern.

FIGS. 23-27 illustrate building units and a surface covering of a fourth embodiment of the rotational tessellation element of the invention.

Figure 23:
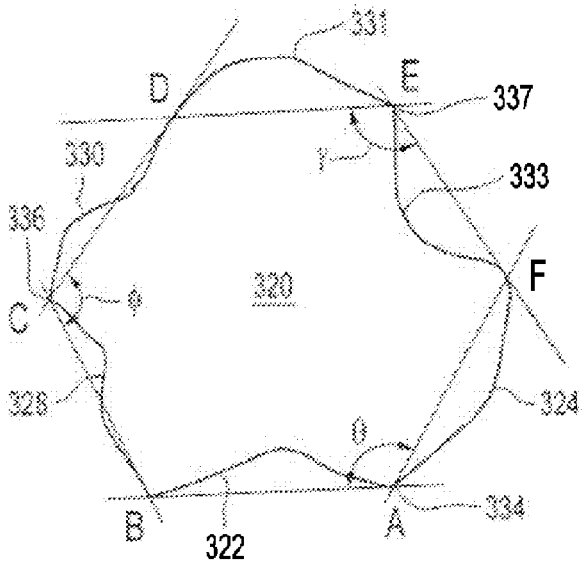
FIGS. 23-27 are illustrations of a fourth embodiment of irregular, tessellated building units of the invention.

FIG. 23 illustrates a primary element 320 of the fourth embodiment. Primary element 320 has a first side 322 extending between points A and B, a second side 324 extending between points A and F. The second side 324 is a rotated image of first side 322 about first vertex 334. The angle θ of rotation is 120 degrees in the fourth embodiment. Basic element 320 further includes a third side 328 extending between points B and C and a fourth side 330 extending between points C and D. Fourth side 330 is a rotated image of third side 328 about second vertex 336. The angle of rotation between sides 3 and 4 is an angle ϕ, which in the case of the fourth embodiment is 120 degrees. Basic element 320 further comprises a fifth side 331 extending between points D and E, and a sixth side 333 extending between points E and F. Sixth side 333 is a rotated image of fifth side 331, about third vertex 337. The angle of rotation γ there between is 120 degrees.

Figure 24:
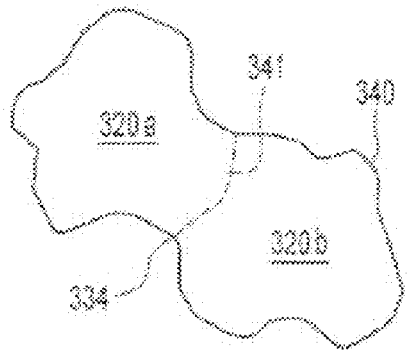

FIG. 24 illustrates a unit 340 comprised of two primary elements 320*a* and 320*b* as indicated by broken line 341. Basic elements 320*a* and 320*b* are joined at the interface between sides one and two of adjacent elements, and share a common first vertex 334.

Figure 25:
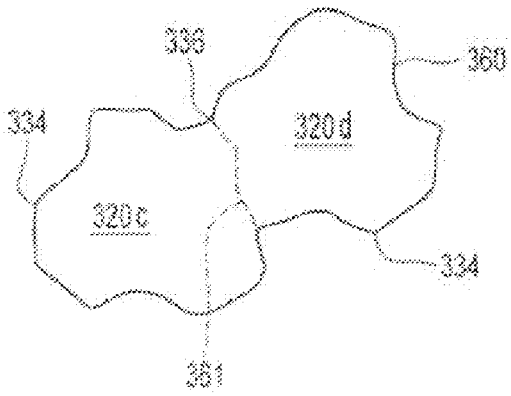

FIG. 25 is a third unit 360 comprised of two primary elements 320*c* and 320*d*, as indicated by broken line 361. Elements 320*c* and 320*d* are joined at the interface of sides three and four of respective elements, and have a common second vertex 336.

Figure 26:
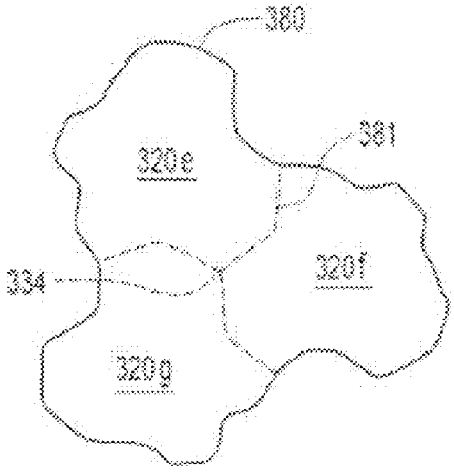

FIG. 26 illustrates a unit 380 comprised of three primary elements from the fourth embodiment, namely, elements 320*e*, 320*f* and 320*g*, as indicated by broken line 381. All three elements revolve around first vertex 334.

Figure 27:
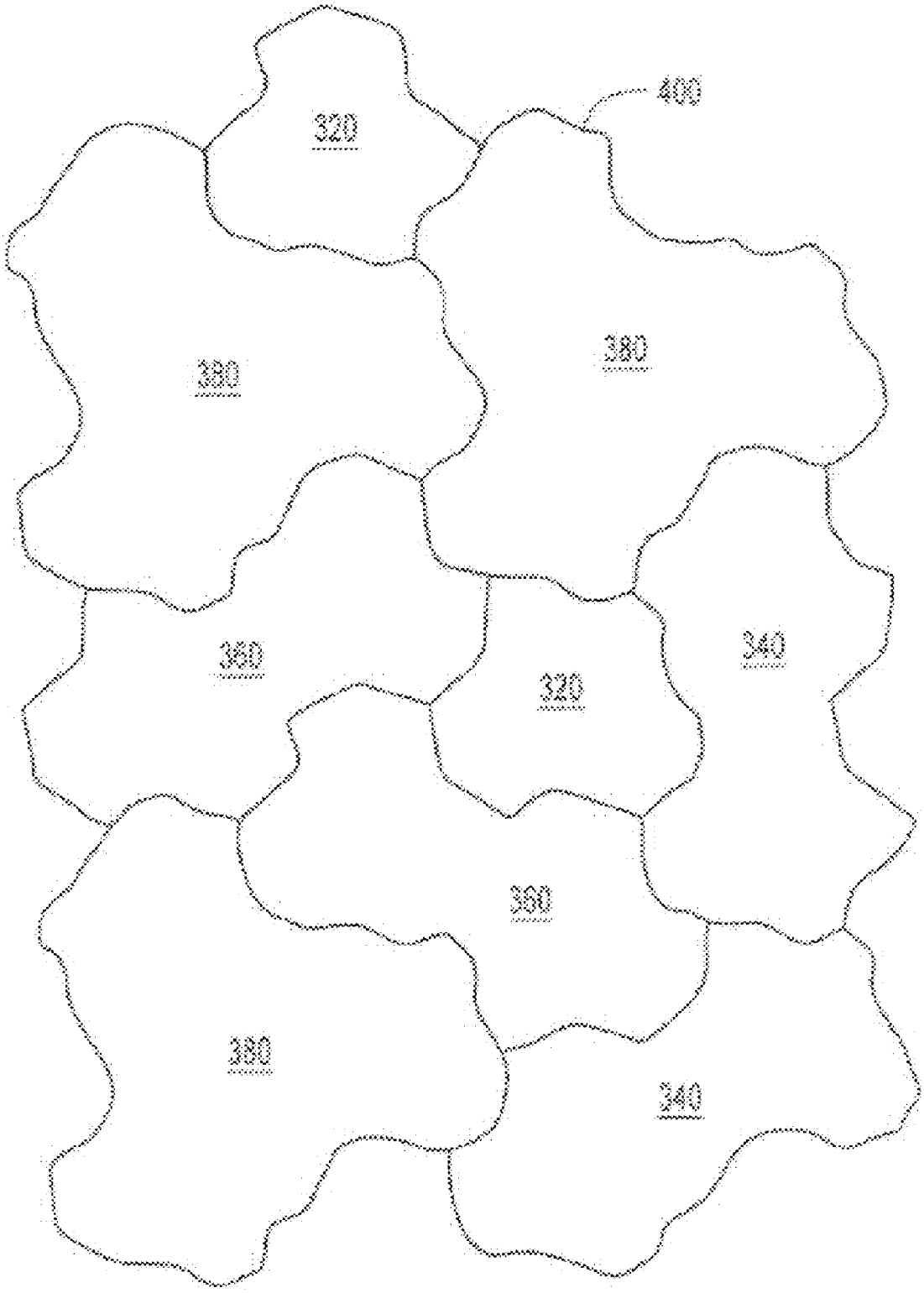

FIG. 27 illustrates a surface covering 400 formed of a mixture of units 320, 340, 360 and 380. As with the other embodiments the surface covering appears to be a natural, irregular and custom made surface, with a non-repeating pattern.

In each of embodiments 1-4 the length of the sides in each pair of sides radiating from each respective vertex is substantially the same, e.g., in the first embodiment, side 22 is the same length as side 24 and side 28 is the same length as side 30. This facilitates mating units as discussed above. However, it is desirable that the lengths of at least one pair of sides in a unit is different from the other pairs. Thus, in the case of the first embodiment, sides 22 and 24 are substantially longer than sides 28 and 30. See FIG. 2. Similarly, in the second embodiment, it can be seen that sides 122-124 are substantially longer than both sides 131-133 and sides 126-128. See FIG. 11. Likewise, each pair of sides in the third and fourth embodiments have different lengths than the other pairs. Preferably the length of each pair of sides is different from the others. Because at least one pair of sides has a different length from the others, in combination with the irregular configuration of the sides, the assembled surface covering has a natural, random appearance as contrasted with conventional surfaces that have a geometric pattern. See, FIGS. 1, 16, 22, 27, for example.

The sum of the vertex angles in embodiments 2-4 are all 360 degrees.

| EMBODIMENT | ANGLE θ | ANGLE ϕ | ANGLE Γ | TOTAL |
|---|---|---|---|---|
| 2 | 60 | 180 | 120 | 360 |
| 3 | 90 | 90 | 180 | 360 |
| 4 | 120 | 120 | 120 | 360 |

Other three vertex tessellations may be provided where each angle θ, ϕ and γ is evenly divisible into 360 degrees and the sum of the angles is 360 degrees. In embodiments one, two and three, the angles at the respective vertices are not the same. In contrast, the angles are all the same, namely 120 degrees, in embodiment four. Embodiments one, two and three, with different vertex angles, produce a more irregular and hence more natural looking unit, as compared to embodiment four which appears somewhat hexagonal. Accordingly, it is preferred that at least one of the vertex angles is different than one of the other vertex angles.

In accordance with the present invention, a wide variety of primary elements can be designed by those skilled in art. The present invention, defined in the appended claims, is not limited to the particular embodiments disclosed. These embodiments are illustrative, not limiting. Further it should be understood that the irregular lines that radiate from each vertex that are shown in the drawings are merely illustrative of the concept. The actual contour of each generally radially extending line is a matter of design choice and all configurations are within the scope of the appended claims. Provided, however, that sides 1-2, 3-4 and 5-6, respectively, are substantially rotational images of one another, as described above.

Figure 28:
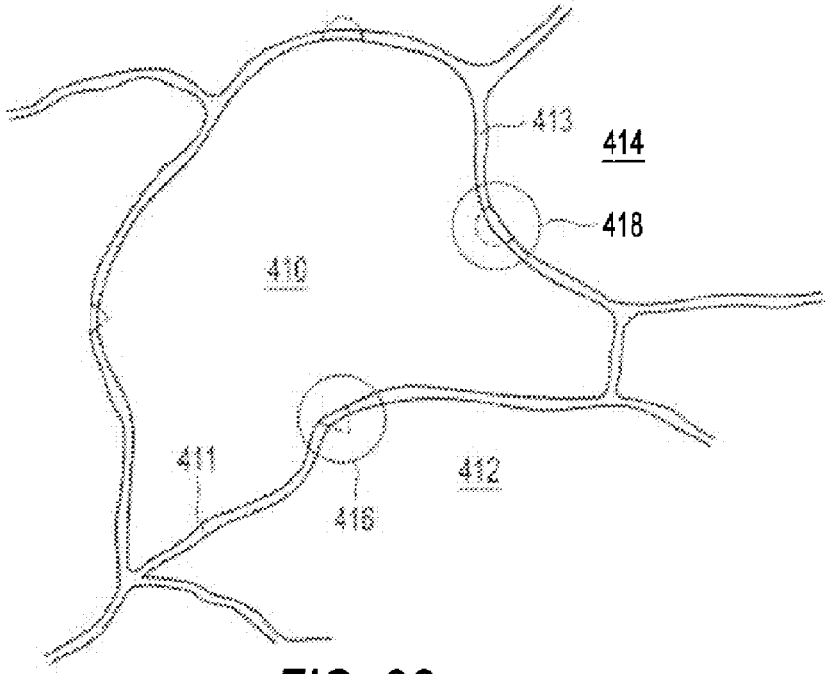
FIG. 28 is an enlarged plan view of a portion of an example surface covering of the invention.

To further enhance the natural appearance of the surface covering it is desirable that the mating edges of adjacent units match less than perfectly, i.e., that the line or gap between units vary in thickness. This is preferably accomplished by introducing minor variations in the sides of the units so that the first and second sides are not identical. Likewise, there may be minor variations between the respective shapes of the third and fourth sides, and so on. Variations, however, cannot be so great as to cause problems in mating adjacent units. FIG. 28 illustrates minor variations in the thickness of the gaps 411 and 413 between adjacent units.

Figure 29:
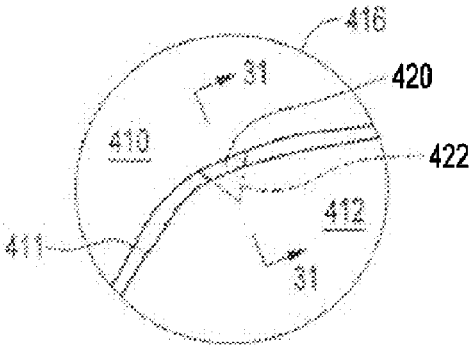
FIG. 29 is an enlarged plan view of a portion of FIG. 28.
Figure 30:
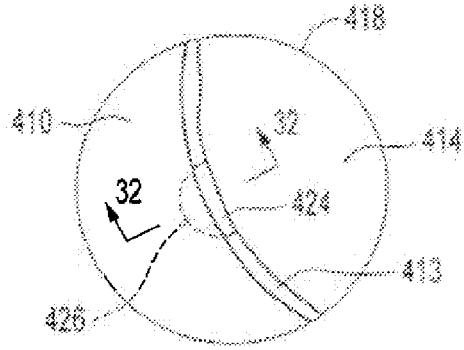
FIG. 30 is an enlarged plan view of a second portion of FIG. 28.
Figure 31:
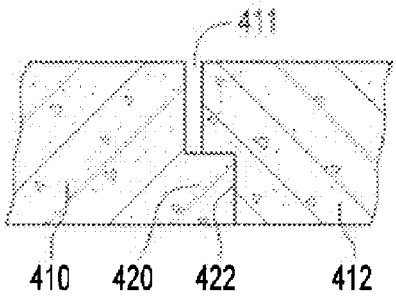
FIG. 31 is a cross-section taken along line 31-31 of FIG. 29.
Figure 32:
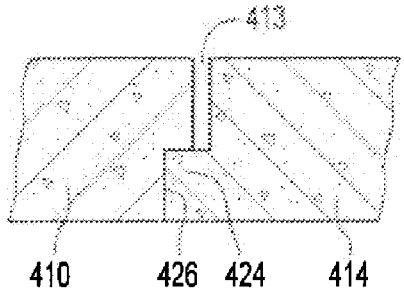
FIG. 32 is a cross-section taken along line 32-32 of FIG. 30.

A further aspect of the invention is the provision of indicia on the sides or bottom surfaces of units to assist in the construction of surface coverings. FIGS. 28-32 illustrate one example of such indicia. FIG. 28 shows units 410, 412 and 414, with gaps 411 and 413 therebetween. FIG. 29 shows an enlarged view of area 416. FIG. 30 shows an enlarged view of area 418. FIGS. 28, 29 and 31 show a V-shaped projection 420 from a lower portion of the second side of unit 410 and a corresponding V-shaped recess 422 in the first side of unit 412. Similarly, FIGS. 28, 30 and 32 show a semi-circular projection 424 from a lower portion of the third side of unit 414 and a corresponding semi-circular shaped recess 426 in unit 410. The size and location of each mating projection-recess are uniformly located a consistent radial distance from the applicable vertex. The projections and recesses are preferably indented from the surface so that they will not be visible in the completed surface covering. Construction is facilitated by easily matching V-shaped projections and recesses, and semi-circular projections and recesses, respectively. It should be understood that the particular shape of the projections and recesses depicted in the drawings are merely illustrative and not limiting. The projections also function to maintain uniform spacing between adjacent units even when the thickness of the gaps 411, 413 vary. Proper spacing assists in maintaining the integrity of the surface over large areas.

Figure 33:
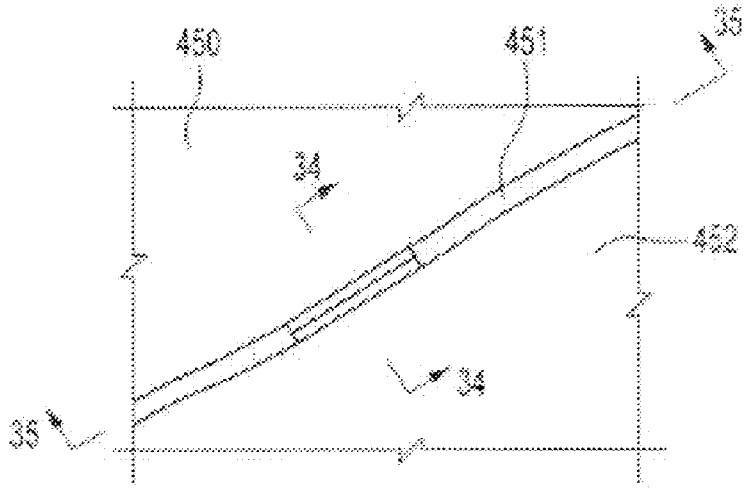
FIG. 33 is an enlarged plan view of a portion of another example surface covering of the invention.
Figure 34:
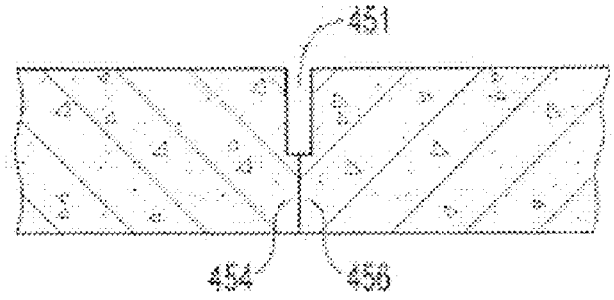
FIG. 34 is a cross-section taken along line 34-34 of FIG. 33.
Figure 35:
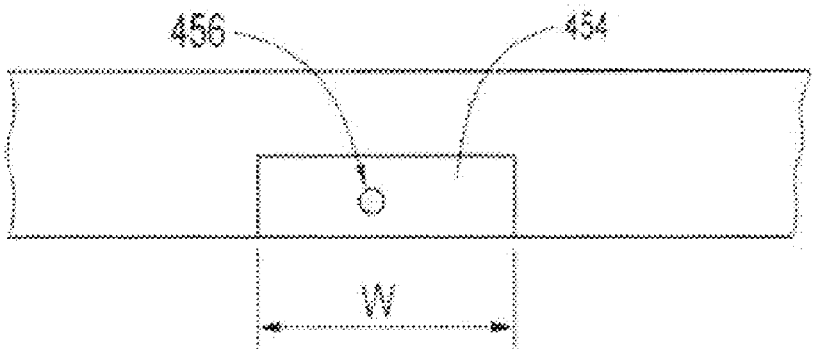
FIG. 35 is a cross-section taken along line 35-35 of FIG. 33.

FIGS. 33-35 illustrate another indicia example to facilitate construction of surface coverings. FIG. 33 is a plan view of two adjacent units 450 and 452 with gap 451 therebetween. Each unit includes a spacer 454 and 456, respectively. Mating sides of respective units can be provided with spacers of the same size and location. Different mating sides are provided with spacers of a different width "W" or shape. Thereby, mating sides can be easily matched. As with the indicia example of FIGS. 28-32, the spacers function to maintain uniform spacing between units despite variations in the width of the gap 451. Optionally, the spacers may be provided with other indicia such as, letters, numbers or symbols to facilitate matching as shown for example at reference numeral 456 in FIG. 35.

Figure 36:
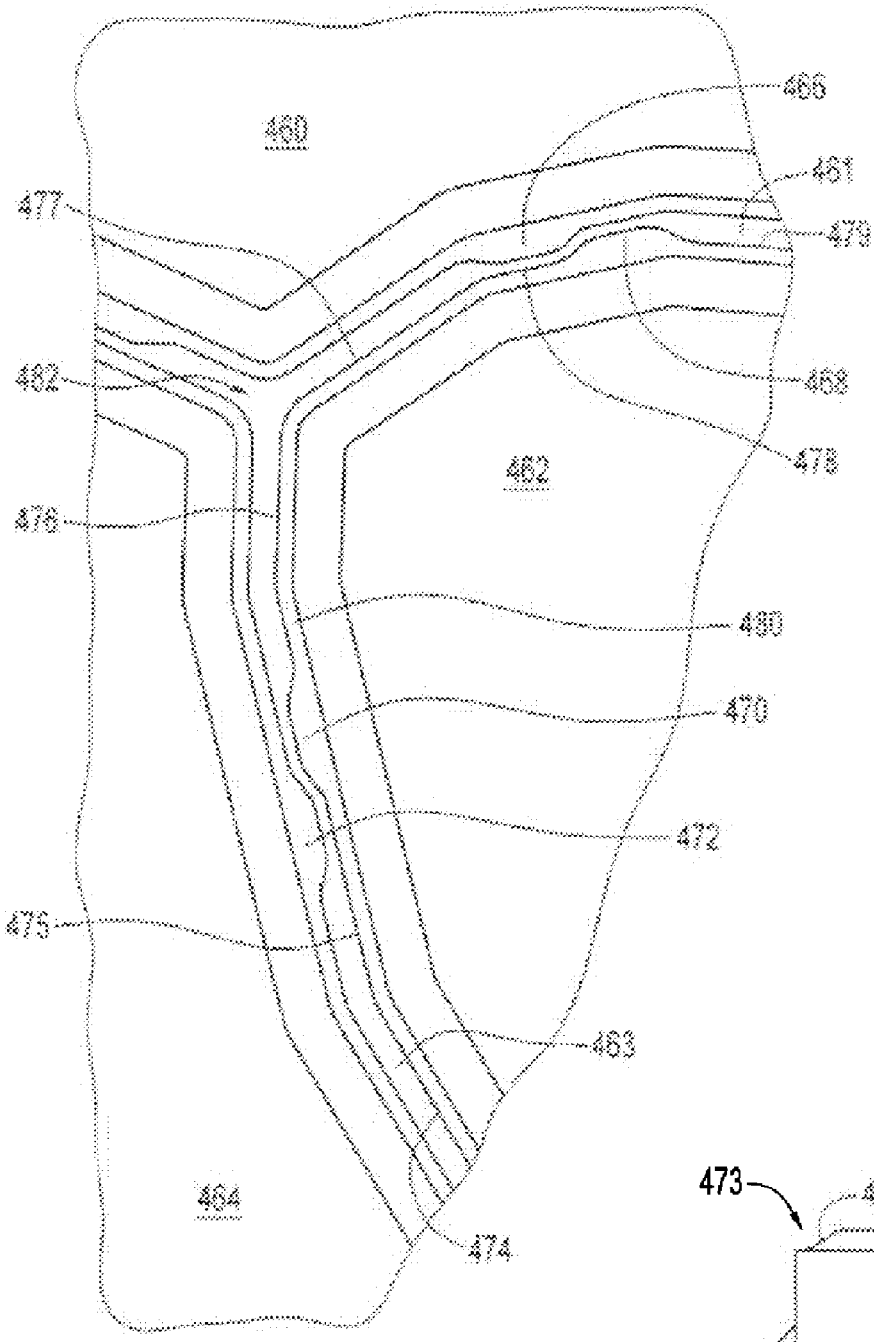
FIG. 36 is an enlarged plan view of a portion of a further example surface covering of the invention.
Figure 37:
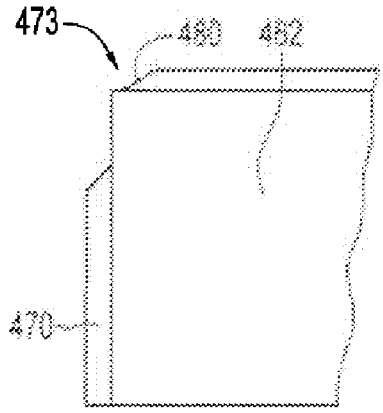
FIG. 37 is an edge detail of a building unit of the invention.
Figure 38:
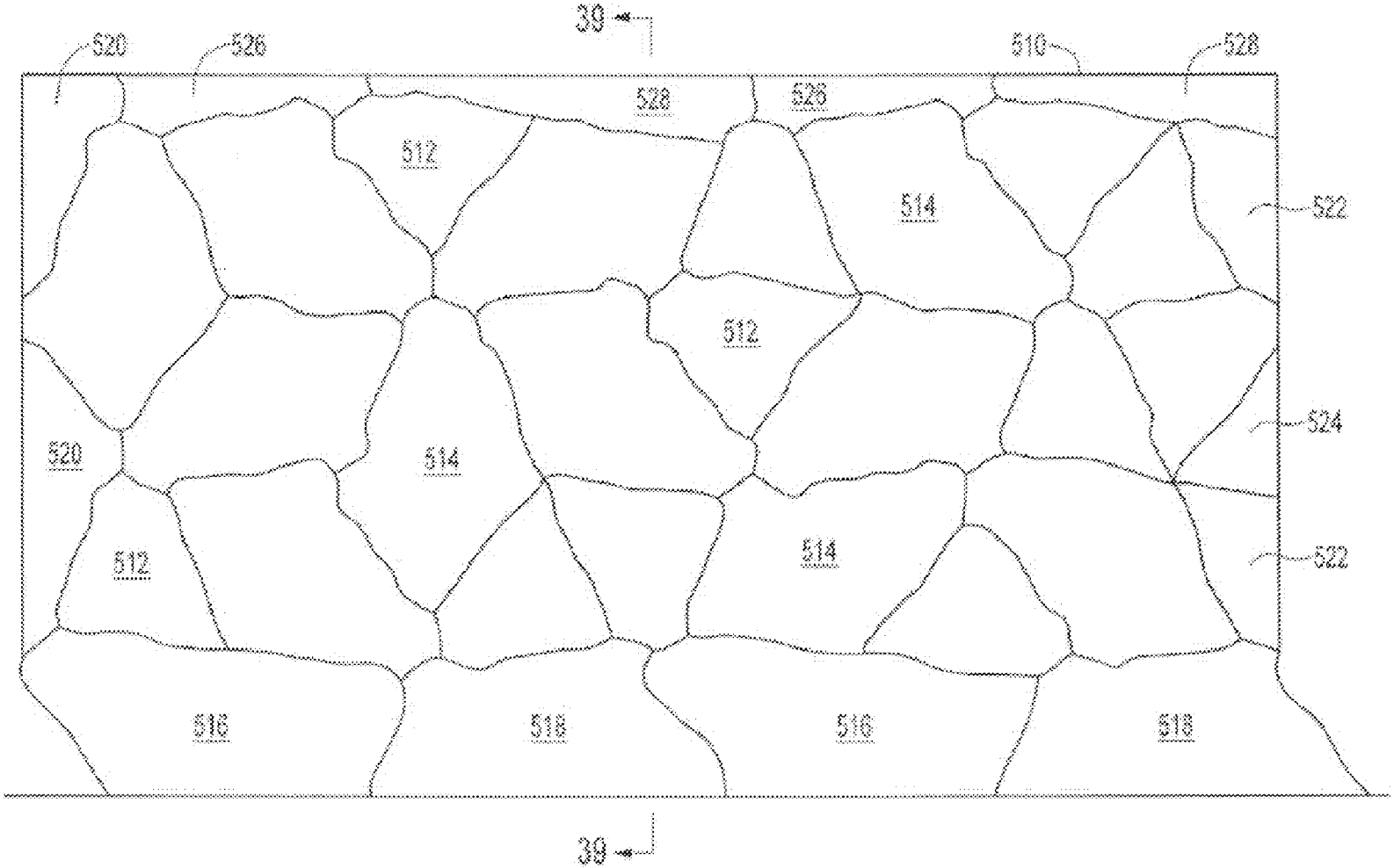
FIG. 38 is an elevational view of a fifth, wall embodiment of the invention.

FIGS. 36 and 37 show another example spacer. FIG. 36 shows three units 460, 462, 464, with gaps 461, 463 there between. All of the units have at least one, preferably a plurality of spacers on each side. FIG. 36 shows unit 460 having a spacer 466, unit 462 having spacer 468, 470, and unit 464 having spacer 472. The spacers in this example are adjacent each other to assist in connecting units. The spacers are preferably located on an inner portion of the unit and typically are not visible in the completed surface. See, FIG. 37. The spacers of each unit define the primary element of the unit, i.e., the angles angle θ, ϕ and γ discussed above are measured in reference to the spacers. To maintain dimensional integrity of the surface covering, it is preferable to have at least two spacers on each side, and to locate the spacers close to the vertices. Although the spacers could be located at the vertices, i.e., corners 482 of the units, it is preferred to locate the spacers a short distance from the corner to reduce the potential for chipping or damage in shipment. Because the spacers define the primary element, the visible side edges, shown generally at 473, are independent of the primary element. Thus, the configuration of the visible edge of each side can be varied with respect to the visible edge of mating sides, which will result in variable gap width between units. Variable gap width further promotes a natural, custom appearance.

Mating of units 460, 462 is facilitated by spacers 466, 468, which help the installer match mating sides. Similarly spacers 470, 472 facilitate mating of units 462, 464. In addition, the spacers interlock and improve the structural integrity of the surface covering or structure.

As can be seen in FIG. 36, the irregular sides of units comprise a series of straight line segments 474, 475, 476, 477, 478, 479. Each segment is set at an angle relative to at least one adjacent segment as shown in FIG. 36. Straight line segments are preferred for mold making. However, the general appearance of the side remains irregular.

An optional bevel 480 is provided on edge 473.

FIGS. 38-42 show a fifth embodiment of the invention, namely a wall structure. Wall 510 comprises a plurality of single primary element building units 512, and a plurality of two element building units 514. Each unit of the fifth embodiment has a tessellated front face in a substantially vertical orientation, whereby assembly of multiple units forms the wall. The sides of each unit extend substantially perpendicularly from the front face, and function as the top, bottom, right and left sides of each unit. It should be understood, however, that although the sides are referred to as top, bottom, right and left for the purposes of function, the sides are actually irregularly shaped and do not lie in horizontal or vertical planes. Further it will be understood that the building units are rotational tessellations such that what might be the top of the unit in one instance could be the bottom in another depending on its orientation.

The fifth embodiment is formed from a multiplicity of building units assembled to form a continuous structure without substantial gaps between units. Each unit is comprised of x primary elements, as discussed above. Unit 512 is comprised of a single primary element. Unit 514 comprise two primary elements. The primary element is an irregular rotational tessellation as described above. A wide variety of units may be constructed having different numbers and arrangements of primary elements. Because all the units are combinations of primary elements, they readily mate with each other. As a result of the irregular side configurations, and different sizes and shapes of individual units, one can construct a wall or other structure that has a natural, random and apparent custom appearance.

The wall further comprises a base or starter course of units 516 and 518, side edge units 520, 522 and 524 and top units 526 and 528. Each of these units comprises a portion of primary element with a cut, straight side to facilitate construction. Alternatively, units may be cut as may be desired on site.

Figure 39:
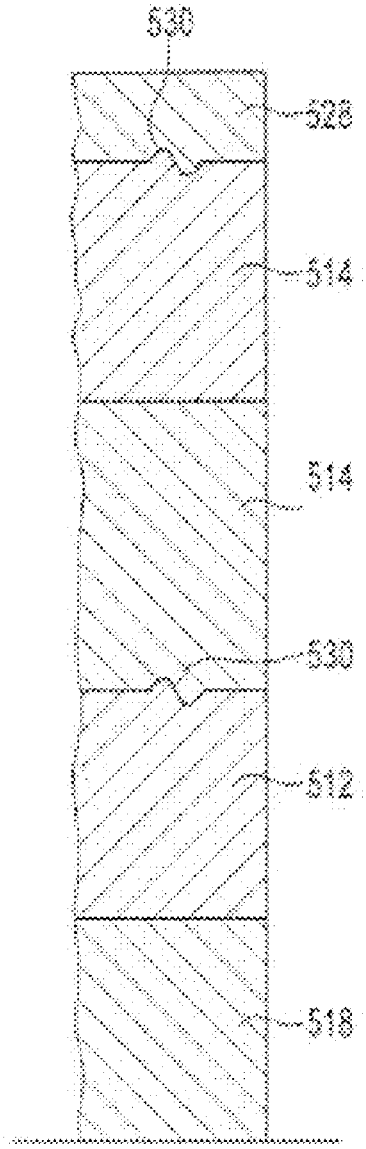
FIG. 39 is cross-section along line 39-39 of FIG. 1.
Figure 40:
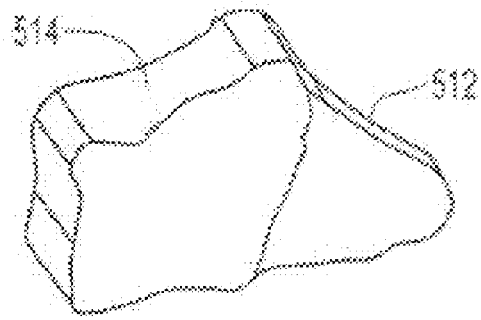
FIG. 40 is a perspective view of a two building units of the fifth embodiment.
Figure 41:
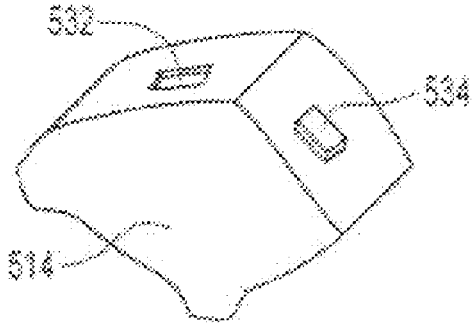
FIG. 41 is a perspective view of a unit of the fifth embodiment.
Figure 42:
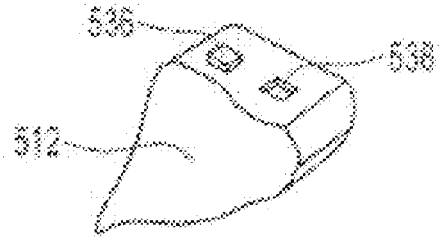
FIG. 42 is a perspective view of another unit of the fifth embodiment.

For structural applications of the invention, it is desirable to provide connectors between units to improve structural integrity. The term "connectors" means a feature that aligns adjacent units and assists in maintaining structural integrity, but does not require that adjacent units are hooked or coupled together. FIG. 39 shows "S" shaped connectors 530 at two locations. An alternative connector is shown in FIG. 41, comprising projection-recess type connectors. Connector 532 is a recess, and connector 534 is a projecting lug having a configuration to mate with a recess 532 of another unit. FIG. 42 shows yet another connector having on one side, both a lug 536 and a recess 538 to mate with corresponding recess and lug of another unit. Alternatively the spacers shown in FIGS. 28-37 can be used a spacers and/or connectors in structural applications.

Figure 43:
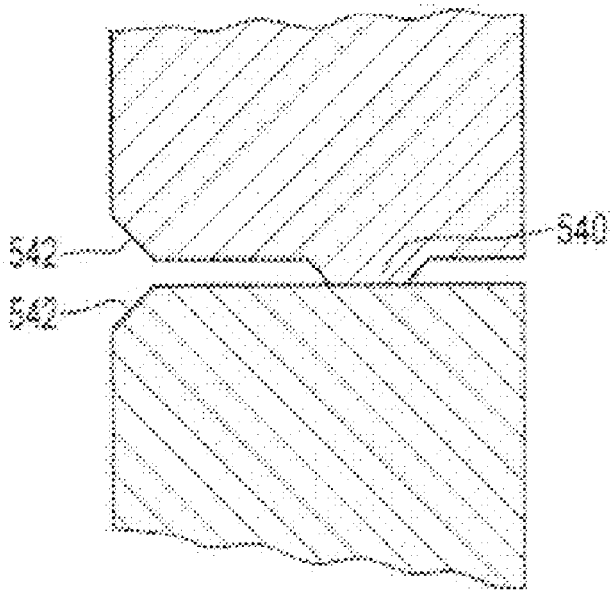
FIG. 43 is an enlarged cross-section of an optional spacer between two units of the fifth embodiment.

FIG. 43 is an enlarged cross-section between two building units showing an example spacer 540. As part of the connectors, or as separate features, each building unit is optionally provided with spacers. The spacers function to create a predetermined gap between units. The gap can provide drainage between units in some applications, e.g., retaining walls, and can be esthetically desirable. Further, the spacers assist in properly spacing units, which is important to maintaining integrity of the "pattern" over large areas. Without spacers small pebbles or debris can be trapped between units, throwing off the "pattern." A further function of the spacers is to improve the structural integrity of the wall. Because the spacers have a relatively small surface area as compared to the side walls, a higher surface pressure (or stress) is applied between the spacer and the adjacent brick, causing the spacer to "dig into" the adjacent unit. The gaps between units formed by the spacers can remain open if desired. Alternatively the gaps may be filled in whole or in part with grout, mortar, sand or other fillers. Grout or mortar further simulates hand laid stone, and adds to the stability of the structure.

Figure 44:
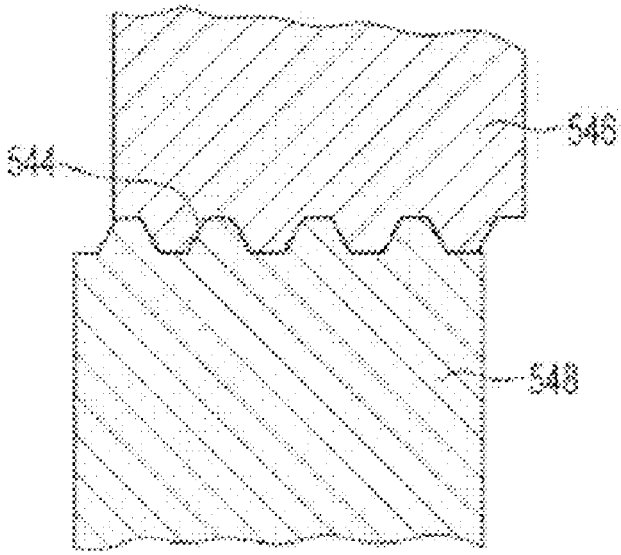
FIG. 44 is an enlarged cross-section of an optional alternative connector of the fifth embodiment.
Figure 1:
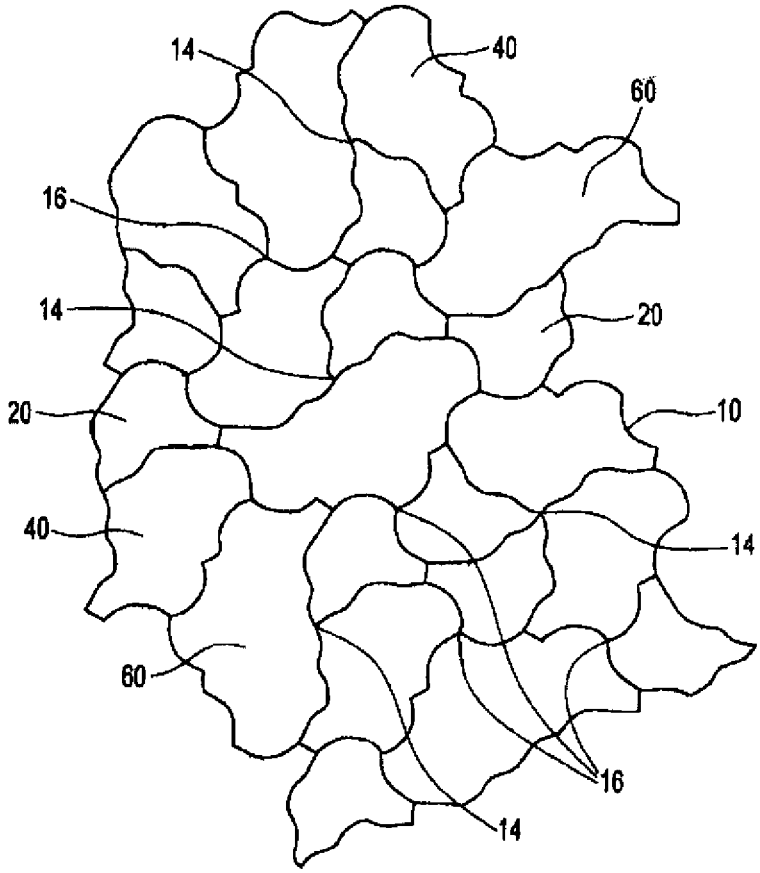
Figure 2:
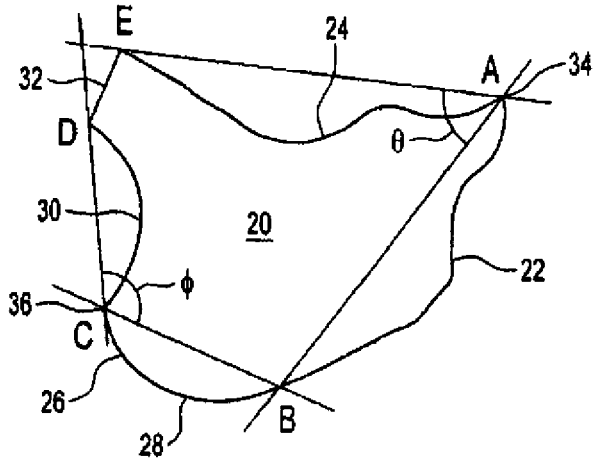
Figure 3:
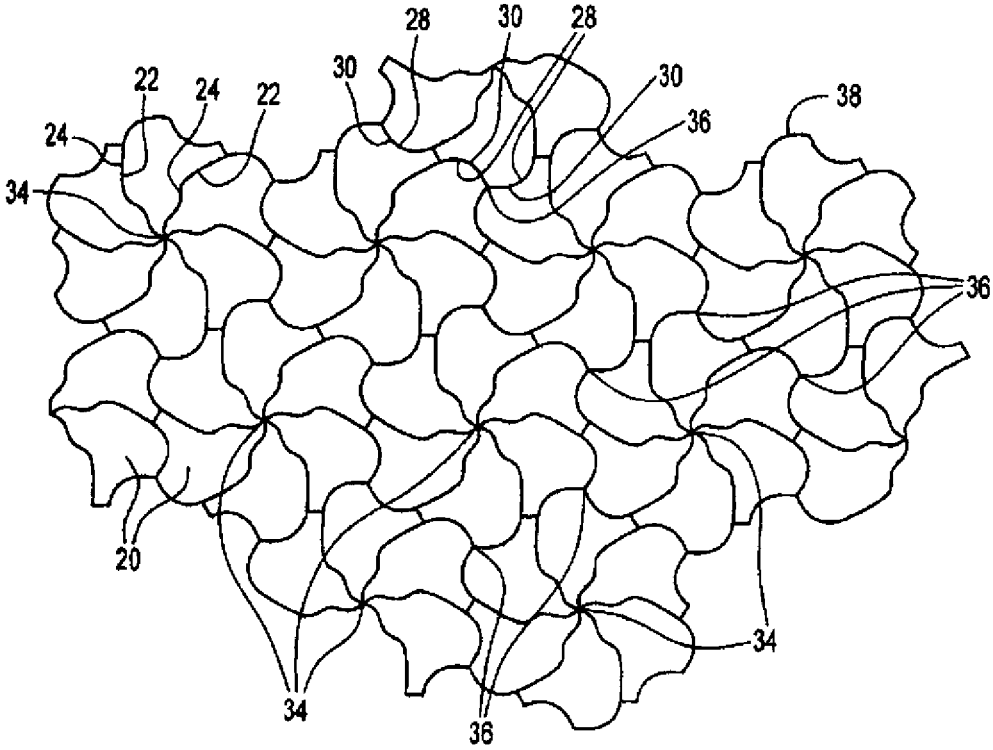
Figure 4:
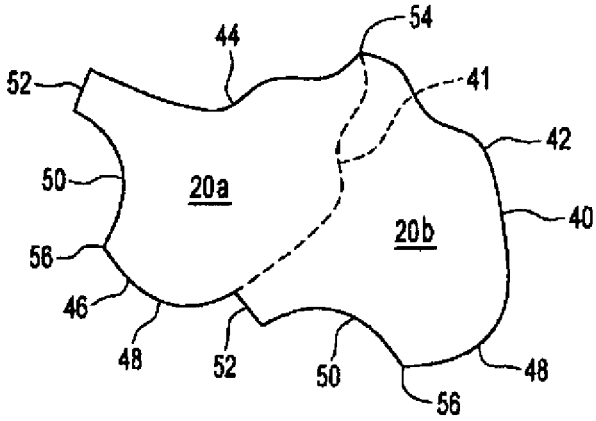
Figure 5:
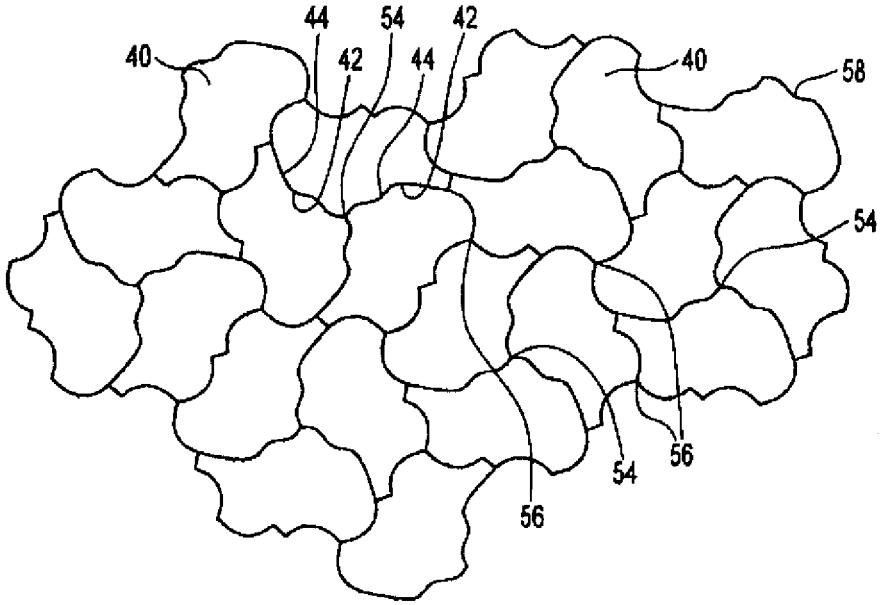
Figure 6:
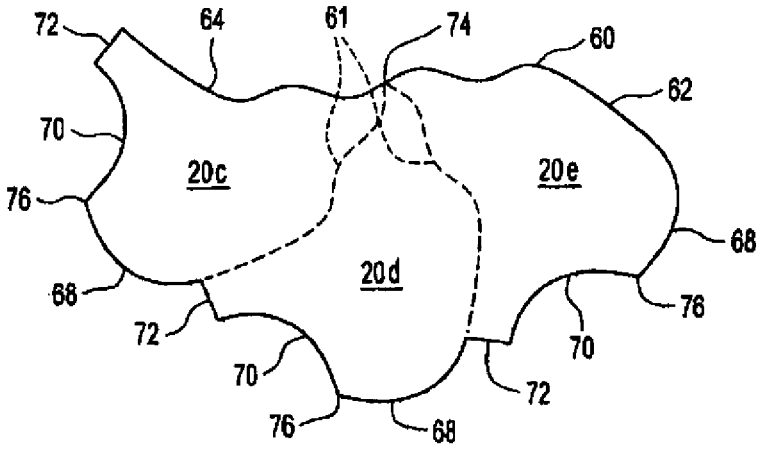
Figure 7:
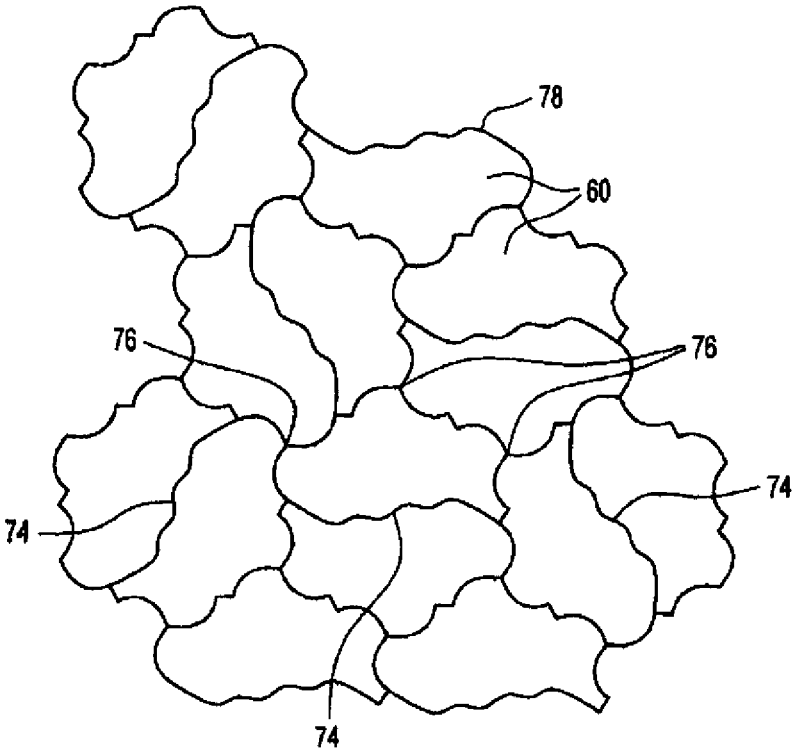
Figure 8:
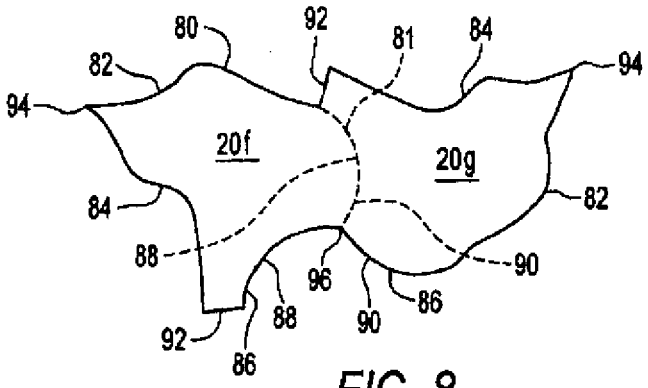
Figure 9:
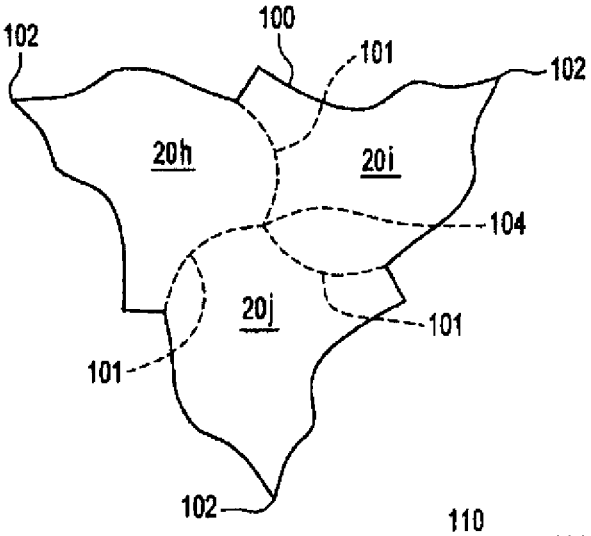
Figure 10:
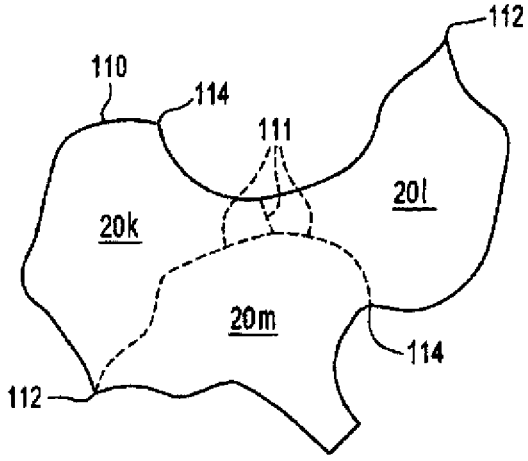
Figure 11:
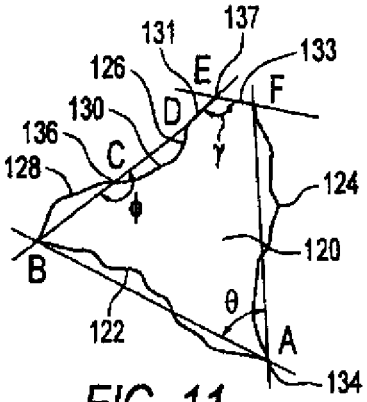
Figure 12:
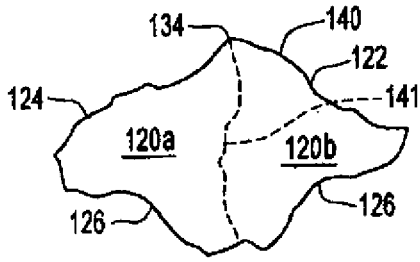
Figure 13:
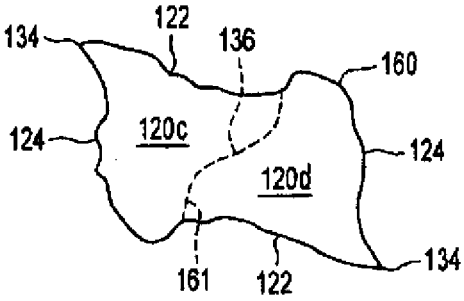
Figure 14:
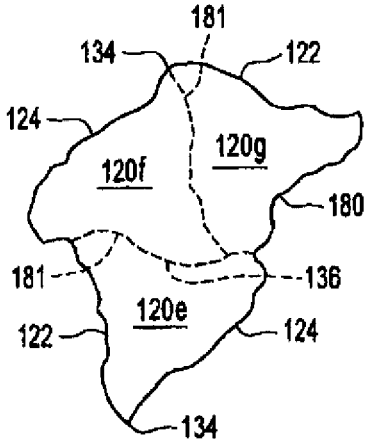
Figure 15:
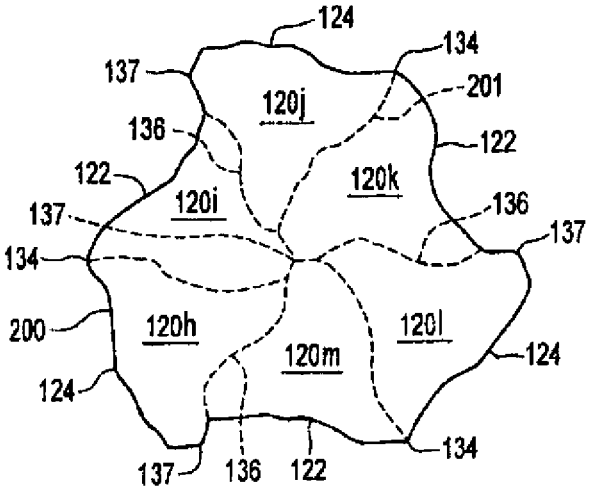
Figure 16:
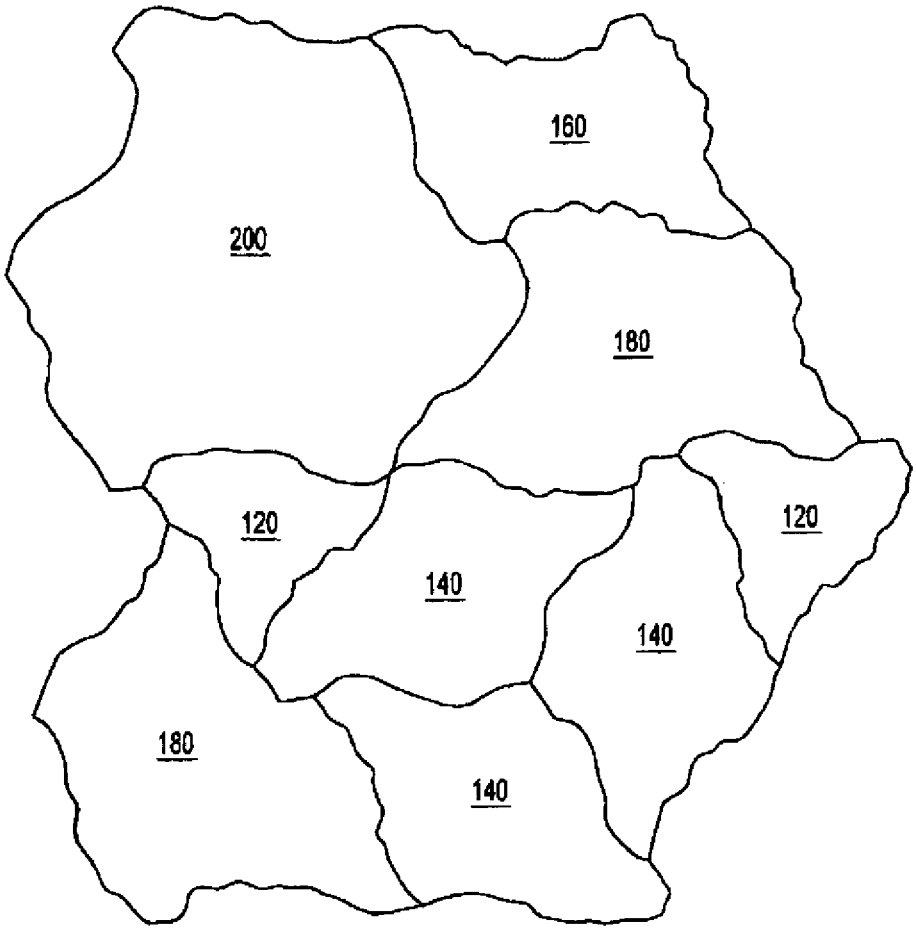
Figure 17:
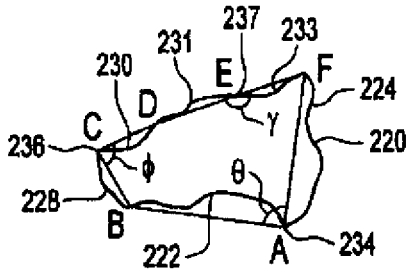
Figure 18:
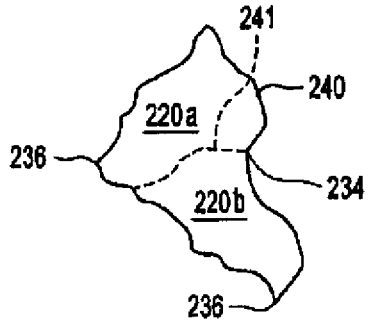
Figure 19:
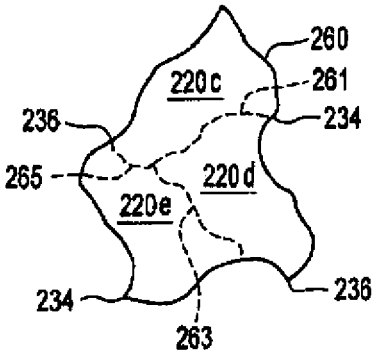
Figure 20:
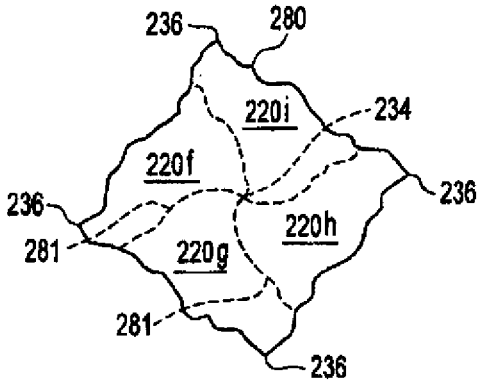
Figure 21:
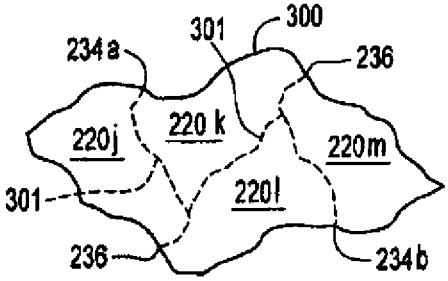
Figure 22:
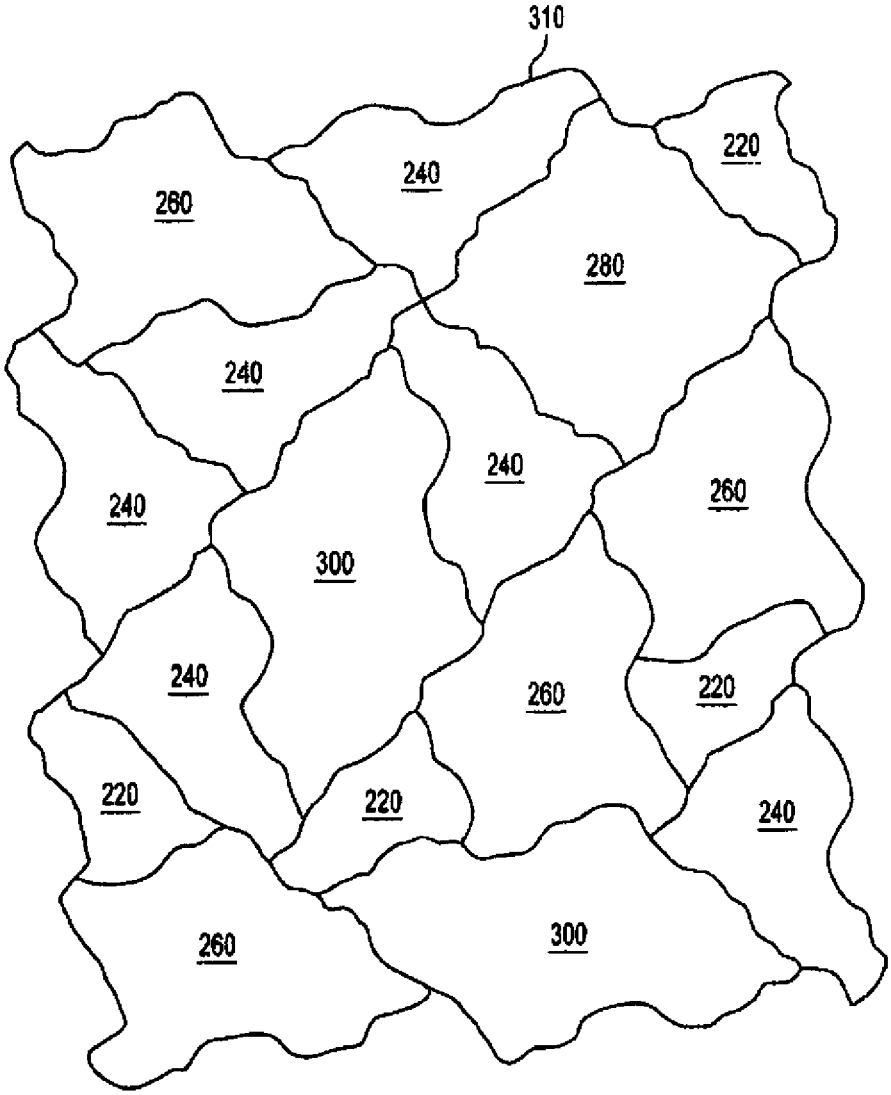
Figure 23:
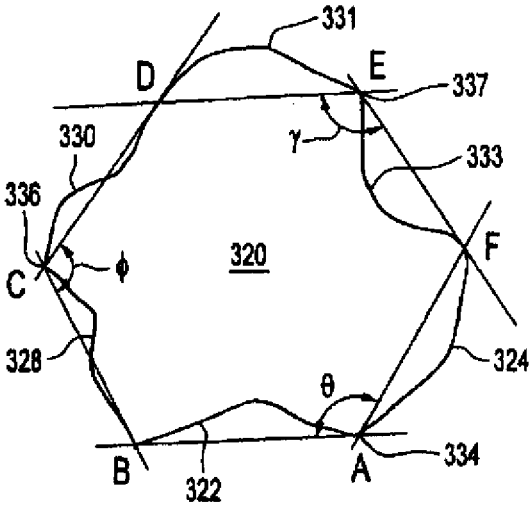
Figure 24:
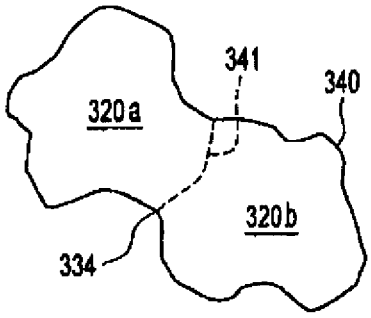
Figure 25:
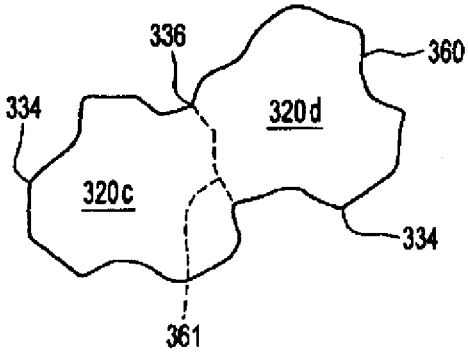
Figure 26:
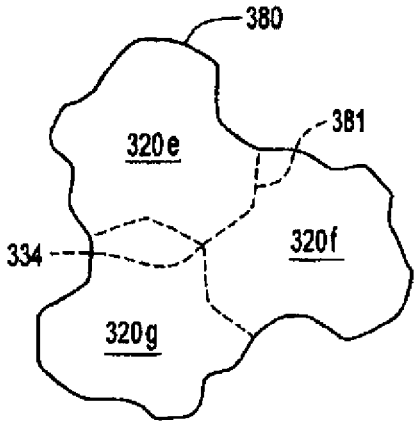
Figure 27:
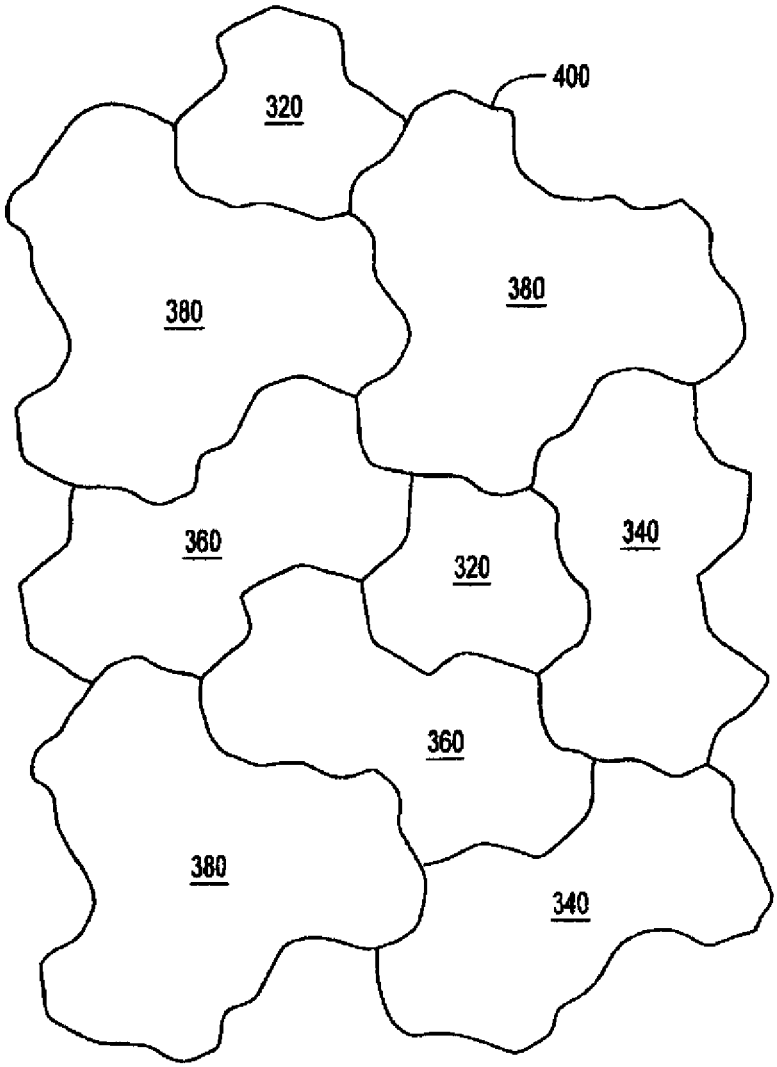
Figure 28:
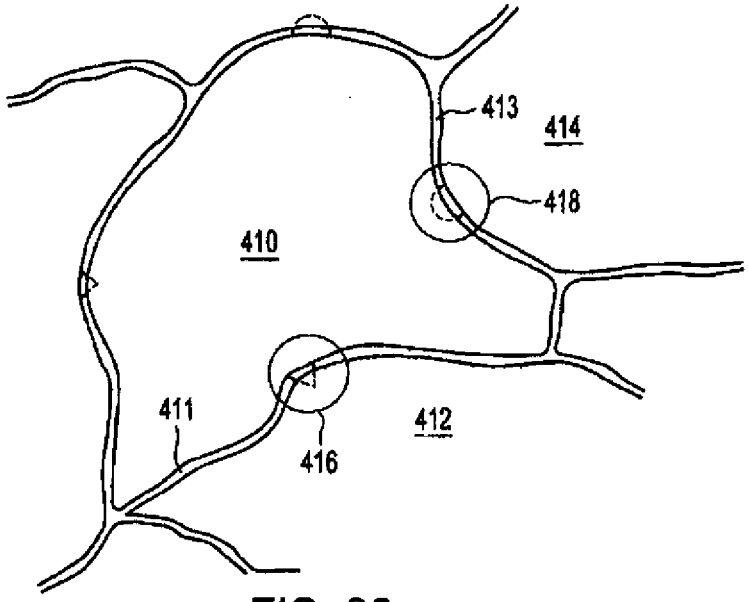
Figure 29:
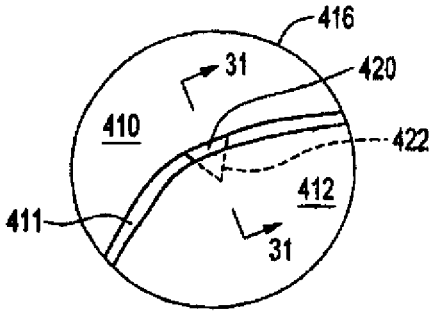
Figure 30:
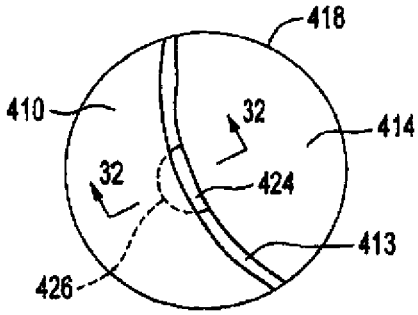
Figure 31:
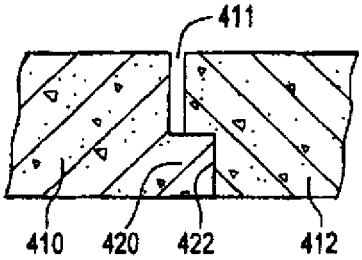
Figure 32:
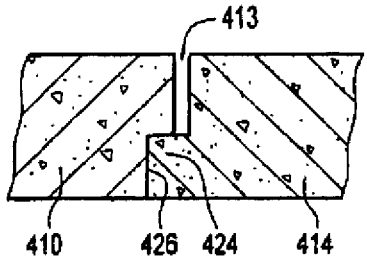
Figure 33:
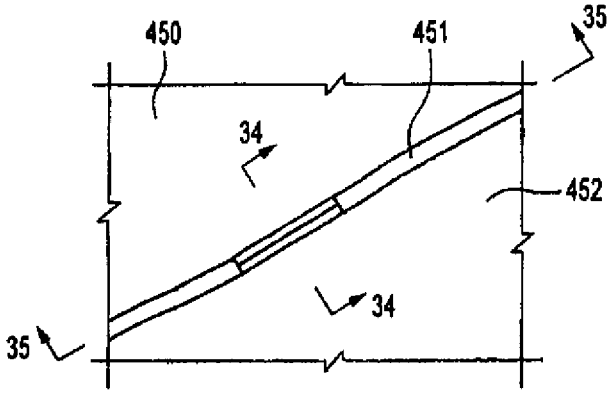
Figure 34:
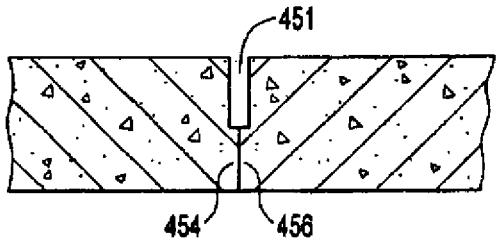
Figure 35:
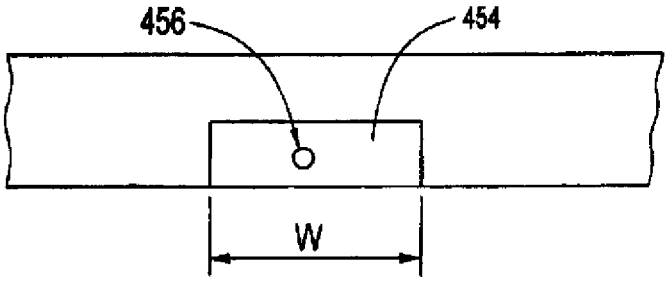
Figure 36:
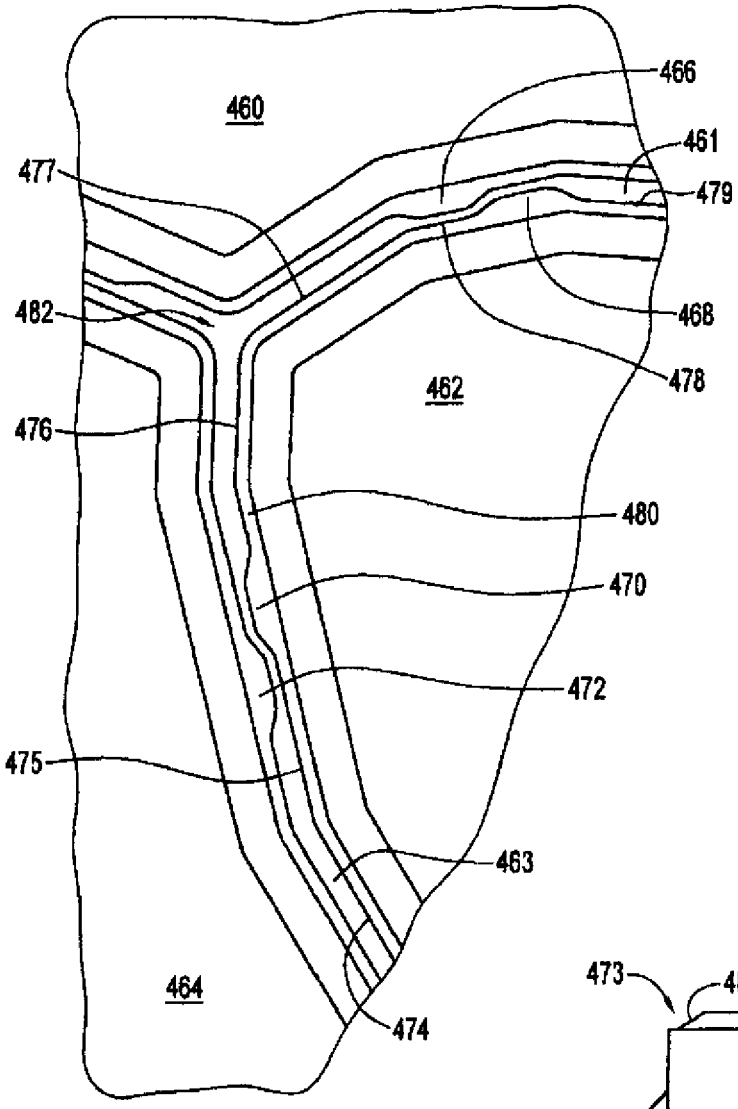
Figure 37:
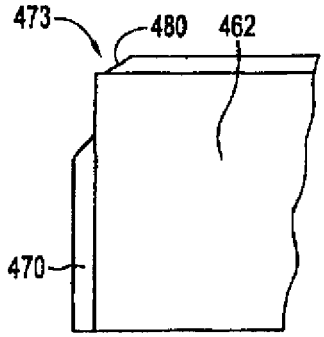
Figure 38:
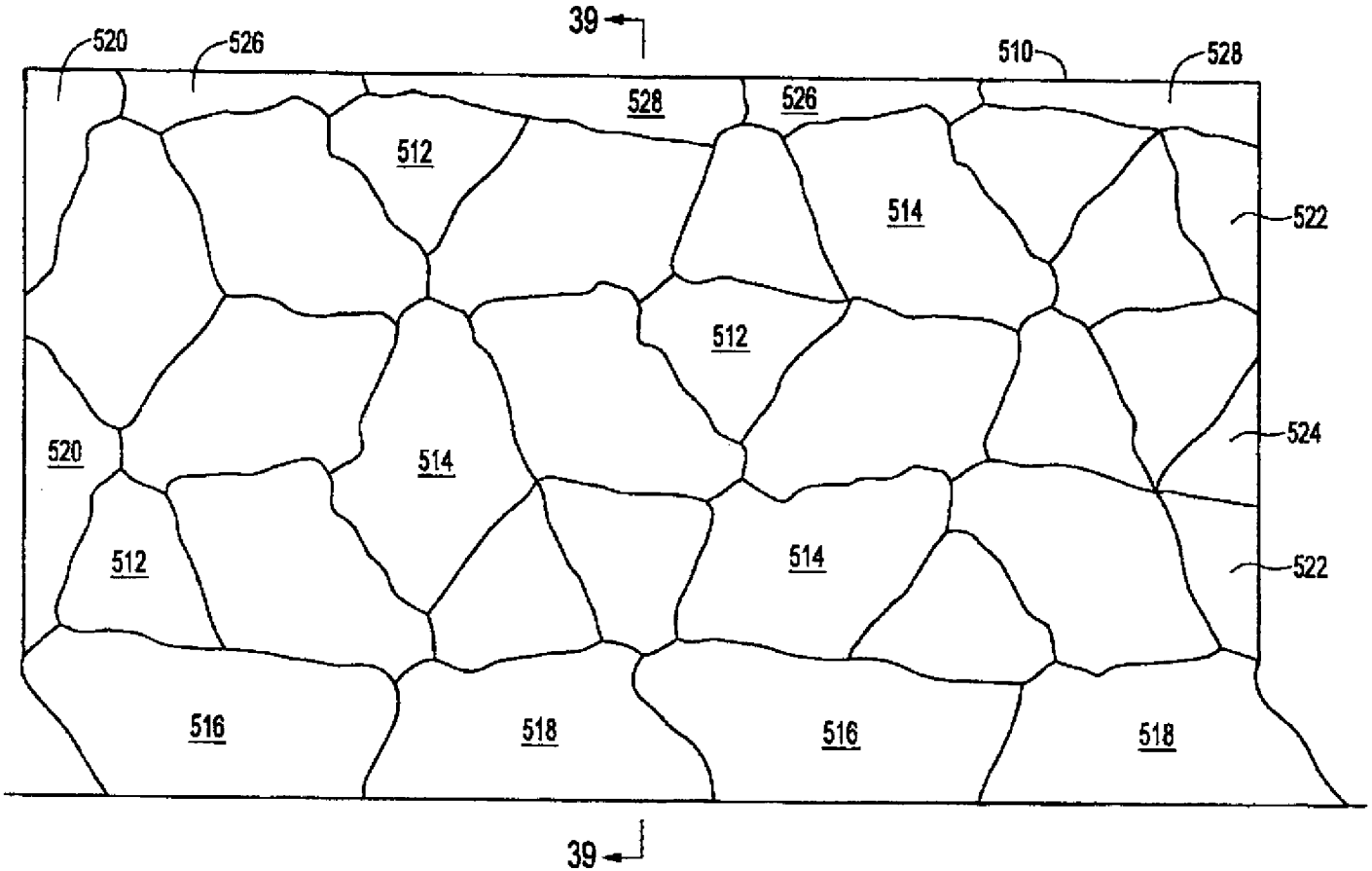
Figure 39:
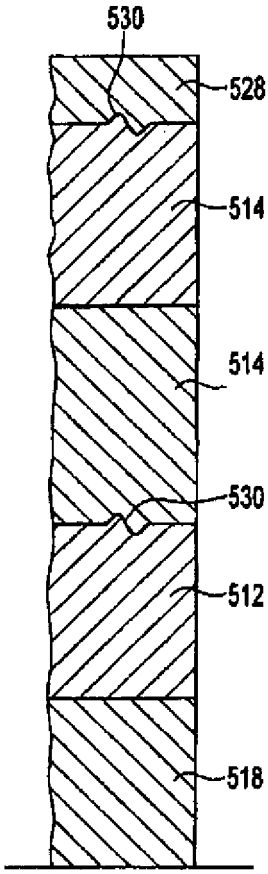
Figure 40:
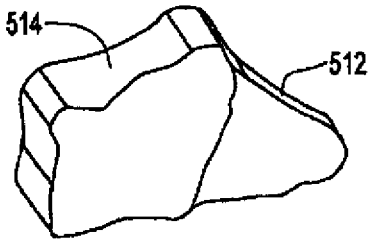
Figure 41:
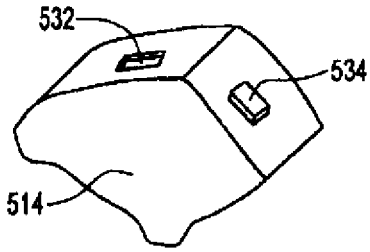
Figure 42:
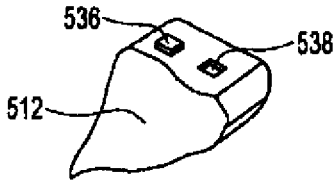
Figure 43:
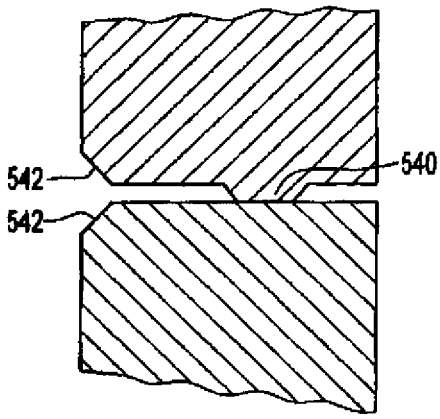
Figure 44:
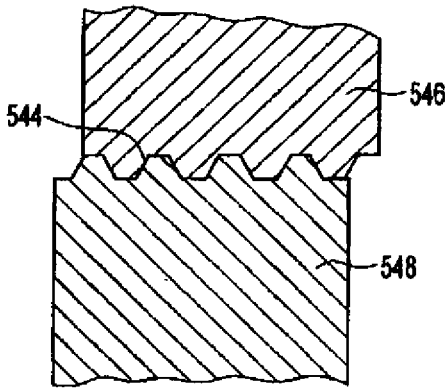

FIG. 44 shows flattened saw-tooth connectors 544 between two building units 546 and 548. The upper unit 546 is recess rearwardly from the lower unit 548. This feature is desirable for retaining walls. Another preferred feature is chamfered or beveled edges 542 between the front and side faces of each unit. Chamfered edges are both functional and add to the appearance of the units.

To further improve the natural appearance of surface coverings it is desirable to provide variations in individual units. Dyes and colorants may be added to the units, and the color and quantity of dye may be regulated to produce color variations from unit to unit. Surface variations from unit to unit are also desirable. One method of introducing surface variation is to tumble the units after curing. Tumbled units and methods for tumbling are well known in the art. An alternative method is to hammer the surface of the unit to create small nicks or marks. Surface variations also may be made in the molds. For example, in a six form assembly, each mold can include a different surface irregularity or variation. Thereby, only every sixth unit would be the same.

The building units of the invention may be made in any conventional manner, for example by molding. Two preferred molding methods are dry cast and wet cast. Dry cast material can be used to mass manufacture low cost units. Wet cast is more expensive, but produces very high quality units. A preferred dry cast method is slip-form molding from dry mix concrete to form units suited for use in walkways, driveways and patios.

In the wet cast process, a form is constructed with side walls conforming to the planar configuration of the unit (as discussed above) with a bottom of the form designed to mold what will be the outer or top surface of the unit. The unit is molded upside down by pouring a concrete mixture into the form and allowing it to cure. An advantage of the wet process is that natural stone materials and other desirable additives may be introduced that are not compatible with mass production by the dry cast process.

Another form of building units of the invention comprises molding stamps, each stamp being comprised of one or more primary elements. Molding stamps are known to persons skilled in the art. Generally, a surface is formed by pouring, spreading and leveling concrete. While the surface is wet (uncured) molding stamps are pressed into the surface, the surface being molded to conform to the stamp. In forming a stamp molded surface at least one stamp is required, but preferably several stamps are used, including stamps of different sizes and/or shapes resulting from different combinations of primary elements. The stamp molds are aligned and mated one to another in the same manner as described above in reference to pavers. The finished surface has a natural stone appearance, without an apparent repeating pattern, but is actually a concrete slab.

While preferred embodiments of the invention have been herein illustrated and described, it is to be appreciated that certain changes, rearrangements and modifications may be made therein without departing from the scope of the invention as defined by the appended claims.

What is claimed is:

1. A building unit having at least one face comprising, a first side extending in a generally radial direction relative to a first vertex, said first side being irregularly shaped;

a second side extending in a generally radial direction relative to the first vertex, said second side having substantially the same length as said first side, being substantially a rotational image of said first side and being rotationally spaced from said first side by a first angle of 360 degrees divided by n, where n is an integer greater than or equal to 3;

a third side extending in a generally radial direction relative to a second vertex, said third side being irregularly shaped, said third side having a length different from said first and second sides, the second vertex being spaced from the first vertex, a fourth side extending in a generally radial direction relative to the second vertex, said fourth side having substantially the same length as said third side, being substantially a rotational image of said third side and being rotationally spaced from said third side by a second angle of 360 degrees divided by m, where m is an integer greater than or equal to 2, a fifth side extending in a generally radial direction relative to a third vertex, said fifth side being irregularly shaped, the third vertex being spaced from the first and second vertices, a sixth side extending in a generally radial direction relative to the third vertex and being substantially a rotational image of said fifth side and rotationally spaced therefrom by a third angle, the sum of the first, second and third angles being substantially 360 degrees, each of said sides one through six having at least one spacer, and said spacers together defining a rotational tessellation comprised of x primary elements, wherein x is an integer equal to or greater than 1.

2. A building unit as in claim 1, wherein said first, second and third angles are substantially equal.

3. A building unit as in claim 1, wherein said spacers are located on an inner portion of the unit indented from said face.

4. A building unit as in claim 1 wherein the configurations of sides two, four and six are substantial rotational images, but not identical configurations, of sides one, three and five, respectively.

5. A building unit as in claim 1 wherein each of said irregularly shaped sides comprise a multiplicity of straight-line segments, each said segment being at angles relative to the other segments such that the general appearance of each of said sides is irregular.

6. A building unit as in claim 1 wherein said face comprises a surface variation mold therein.

7. A building unit comprising, at least one face having three vertices and a pair of sides extending from each said vertex, the sides of each pair having a jagged configuration of substantially equal length and being rotational images of each other, at least one pair of sides having a length that is different from the lengths of the other pairs of sides, and spacers projecting from each side, at least one primary rotational tessellation element being defined by said spacers.

* * * * *

UNITED STATES PATENT AND TRADEMARK OFFICE

CERTIFICATE OF CORRECTION

PATENT NO. : 7,393,155 B2
APPLICATION NO. : 10/550121
DATED : July 1, 2008
INVENTOR(S) : Riccobene It is certified that error appears in the above-identified patent and that said Letters Patent is hereby corrected as shown below:

The title page, showing an illustrative figure, should be deleted and substitute therefor the attached title page.

Delete drawing sheets 1-17 and substitute therefor the drawing sheets, consisting of figures 1-44 as shown on the attached pages.

Signed and Sealed this

Fifth Day of January, 2010

David J. Kappos

David J. Kappos
*Director of the United States Patent and Trademark Office*

(12) United States Patent
Riccobene

(10) Patent No.: US 7,393,155 B2
(45) **Date of Patent: *Jul. 1, 2008**

(54) IRREGULAR TESSELLATED BUILDING UNITS

(75) Inventor: Thomas S. Riccobene, Albuquerque, NM (US)

(73) Assignee: Riccobene Designs LLC, Albuquerque, NM (US)

( * ) Notice: Subject to any disclaimer, the term of this patent is extended or adjusted under 35 U.S.C. 154(b) by 169 days.

This patent is subject to a terminal disclaimer.

(21) Appl. No.: 10/550,121

(22) PCT Filed: Mar. 24, 2004

(86) PCT No.: PCT/US2004/009148

§ 371 (c)(1),
(2), (4) Date: Sep. 19, 2005

(87) PCT Pub. No.: WO2004/085755

PCT Pub. Date: Oct. 7, 2004

(65) Prior Publication Data

US 2006/0182923 A1 Aug. 17, 2006
US 2007/0098945 A2 May 3, 2007

Related U.S. Application Data

(60) Provisional application No. 60/503,936, filed on Sep. 18, 2003.

(51) Int. Cl.
*E01C 5/00* (2006.01)

(52) U.S. Cl. ..... 404/38; 404/41; 428/44; 428/48; 52/603

(58) Field of Classification Search ..... 428/44, 428/48; 404/37, 38, 41, 34; 52/311.2, 392, 52/603

See application file for complete search history.

(56) References Cited

U.S. PATENT DOCUMENTS 4,217,740 A 8/1980 Assanti (Continued)

FOREIGN PATENT DOCUMENTS

DE 4232300 3/1994

(Continued)

OTHER PUBLICATIONS

Nature Walk™ Natural Flagstone Appeal for Pedestrian Traffic, Sep. 2003.

(Continued)

*Primary Examiner*—Alexander Thomas
(74) *Attorney, Agent, or Firm* Greer, Burns & Crain, Ltd

(57) ABSTRACT

An irregular, tessellated building unit comprises x primary elements, wherein x is an integer equal to or greater than 1. The primary element is a rotational tessellation having a plural pairs of sides extending in a generally radial direction from plural vertices, respectively. In each pair, the two sides are rotationally spaced by an angle that is divided evenly into 360 degrees. Preferably, all of the sides are irregularly shaped, but one or more sides could be wholly or partially straight. Optionally, spacers are provided on the sides of each unit. A wide variety of units may be constructed having different numbers and arrangements of primary elements. As all the units are combinations of primary elements, they readily mate with each other. A surface covering comprises a multiplicity of units assembled to form a continuous surface without overlap between units and without substantial gaps between units. A structure, such as a wall or column can be formed of building units of the invention. Because of the irregular side configurations, and different sizes and shapes of individual units, the resulting surface or structure has a natural, non-repeating pattern appearance. Optionally, minor surface and edges variations are made from unit to unit to further enhance the natural appearance of the surface covering or structure.

7 Claims, 17 Drawing Sheets

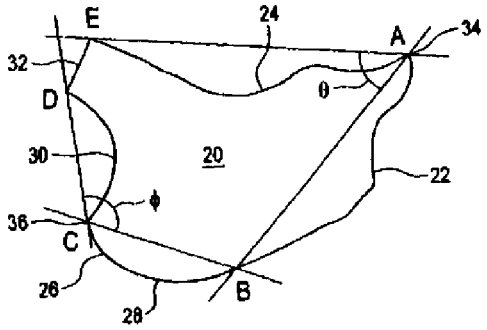

UNITED STATES PATENT AND TRADEMARK OFFICE

CERTIFICATE OF CORRECTION

PATENT NO. : 7,393,155 B2
APPLICATION NO. : 10/550121
DATED : July 1, 2008
INVENTOR(S) : Thomas S. Riccobene It is certified that error appears in the above-identified patent and that said Letters Patent is hereby corrected as shown below:

Title Page,

Under Related U.S. Application Data, before "Provisional" insert -- Continuation in part of U.S. Pat. App. No. 10/395,537 filed March 24, 2003, now Pat. No. 6,881,463 issued April 19, 2005, and --

Signed and Sealed this
Twelfth Day of June, 2012

David J. Kappos

David J. Kappos
*Director of the United States Patent and Trademark Office*